US009611572B2

(12) United States Patent
Moore et al.

(10) Patent No.: US 9,611,572 B2
(45) Date of Patent: Apr. 4, 2017

(54) DIMENSIONALLY STABLE NONWOVEN FIBROUS WEBS, AND METHODS OF MAKING AND USING THE SAME

(75) Inventors: Eric M. Moore, Roseville, MN (US); John D. Stelter, Hudson, WI (US); Michael R. Berrigan, Oakdale, MN (US); Francis E. Porbeni, Woodbury, MN (US); Matthew T. Scholz, Woodbury, MN (US); Korey W. Karls, Coon Rapids, MN (US); Sian F. Fennessey, Wettingen (CH); Scott J. Tuman, Woodbury, MN (US); Cordell M. Hardy, Woodbury, MN (US); Yifan Zhang, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 503 days.

(21) Appl. No.: 13/879,182

(22) PCT Filed: Oct. 14, 2011

(86) PCT No.: PCT/US2011/056257

§ 371 (c)(1),
(2), (4) Date: Jul. 10, 2013

(87) PCT Pub. No.: WO2012/051479

PCT Pub. Date: Apr. 19, 2012

(65) Prior Publication Data

US 2013/0288556 A1 Oct. 31, 2013

Related U.S. Application Data

(60) Provisional application No. 61/393,352, filed on Oct. 14, 2010.

(51) Int. Cl.

| | |
|---|---|
| ***D04H 1/435*** | (2012.01) |
| ***D04H 1/541*** | (2012.01) |
| ***D01F 1/10*** | (2006.01) |
| ***D01F 6/62*** | (2006.01) |
| ***D01F 6/92*** | (2006.01) |

(52) U.S. Cl.

CPC ..... *D04H 1/435* (2013.01); *D01F 1/10* (2013.01); *D01F 6/62* (2013.01); *D01F 6/92* (2013.01); *D04H 1/541* (2013.01); *Y10T 442/608* (2015.04); *Y10T 442/696* (2015.04)

(58) Field of Classification Search

CPC .... D01F 1/10; D01F 6/62; D01F 6/92; D04H 1/435; D04H 1/541; Y10T 442/608; Y10T 442/696

IPC ..... D01F 1/10,6/62; D04H 1/435, 1/541; Y10T 442/608, 442/696

See application file for complete search history.

(56) References Cited

U.S. PATENT DOCUMENTS

| | | | |
|---|---|---|---|
| 1,975,504 | A | 10/1934 | Formhals |
| RE24,906 | E | 12/1960 | Ulrich |
| 3,121,021 | A | 2/1964 | Copeland |
| 3,389,827 | A | 6/1968 | Abere |
| 3,485,706 | A | 12/1969 | Evans |
| 3,565,985 | A | 2/1971 | Schrenk |
| 3,575,782 | A | 4/1971 | Hansen |
| 3,816,229 | A | 6/1974 | Bierbrauber |
| 3,825,379 | A | 7/1974 | Lohkamp |
| 3,825,380 | A | 7/1974 | Harding |
| 3,849,241 | A | 11/1974 | Butin |
| 3,874,886 | A | 4/1975 | Levecque |
| 3,896,251 | A | 7/1975 | Landucci |
| 4,024,178 | A | 5/1977 | Landucci |
| 4,054,592 | A | 10/1977 | Dear |
| 4,103,058 | A | 7/1978 | Humlicek |
| 4,112,213 | A | 9/1978 | Waldman |
| 4,118,531 | A | 10/1978 | Hauser |
| 4,310,509 | A | 1/1982 | Berglund |
| 4,323,557 | A | 4/1982 | Rosso |
| 4,363,646 | A | 12/1982 | Torobin |
| 4,401,780 | A | 8/1983 | Steel |
| 4,448,983 | A | 5/1984 | Young |
| 4,477,498 | A | 10/1984 | Deiner |
| 4,536,361 | A | 8/1985 | Torobin |
| 4,540,479 | A | 9/1985 | Sakurai |
| 4,606,737 | A | 8/1986 | Stern |
| 4,668,406 | A | 5/1987 | Chang |
| 4,737,410 | A | 4/1988 | Kantner |
| 4,744,365 | A | 5/1988 | Kaplan |
| 4,863,779 | A | 9/1989 | Daponte |
| 5,016,331 | A | 5/1991 | Dilo |

(Continued)

FOREIGN PATENT DOCUMENTS

| | | |
|---|---|---|
| CN | 101784720 | 7/2010 |
| EP | 569154 | 11/1993 |

(Continued)

OTHER PUBLICATIONS

Dahiya et al, "Spunbond Technology", Apr. 2004, pp. 1-11.*

Thermoplastics—An Introduction, by Chris Sammon, Feb. 14, 2001, pp. 1-6, http://www.azom.com/article.aspx?ArticleID=83.*

Chapter 6: Processing Amorphous and Semi-Crystalline Thermoplastics, dated 2004, by Vanessa Goodship, pp. 1-2.*

Mezghani, "High Speed Melt Spinning of Poly(L-lactic acid) Filaments", *Journal of Polymer Science, Part B: Polymer Physics*, 1998, vol. 36,pp. 1005-1012.

Narayanan, Nonwovens Conference and Trade Fair, TAPPI Proceedings,"Dimensional Stability of Melt Blown Polyester Nonwovens", Mar. 9-11, 1998, pp. 29-36.

(Continued)

*Primary Examiner* — Elizabeth M Cole

(57) ABSTRACT

Dimensionally stable nonwoven fibrous webs include a plurality of fibers formed from one or more thermoplastic polyesters and an antishrink additive, preferably in an amount greater than 0% and no more than 10% by weight of the web. The webs have at least one dimension which decreases by no greater than 12% in the plane of the web when heated to a temperature above a glass transition temperature of the fibers. The webs may be used as wipes.

36 Claims, No Drawings

(56) References Cited

U.S. PATENT DOCUMENTS

| | | | |
|---|---|---|---|
| 5,027,803 | A | 7/1991 | Scholz |
| 5,045,387 | A | 9/1991 | Schmalz |
| 5,227,107 | A | 7/1993 | Dickenson |
| 5,268,733 | A | 12/1993 | Wright |
| 5,364,694 | A | 11/1994 | Okada |
| 5,382,400 | A | 1/1995 | Pike |
| 5,427,842 | A | 6/1995 | Bland |
| 5,475,063 | A | 12/1995 | Kaplan |
| 5,496,507 | A | 3/1996 | Angadjivand |
| 5,496,603 | A | 3/1996 | Riedel |
| 5,525,706 | A | 6/1996 | Gruber |
| 5,585,056 | A | 12/1996 | Liu |
| 5,589,122 | A | 12/1996 | Leonard |
| 5,599,602 | A | 2/1997 | Leonard |
| 5,631,073 | A | 5/1997 | Riedel |
| 5,660,922 | A | 8/1997 | Herridge |
| 5,679,190 | A | 10/1997 | Riedel |
| 5,698,322 | A | 12/1997 | Tsai |
| 5,731,062 | A | 3/1998 | Kim |
| 5,741,563 | A | 4/1998 | Mehta |
| 5,753,736 | A | 5/1998 | Bhat |
| 5,833,787 | A | 11/1998 | Ehret |
| 5,883,199 | A | 3/1999 | McCarthy |
| 5,910,368 | A | 6/1999 | Ehret |
| 5,952,088 | A | 9/1999 | Tsai |
| 5,952,433 | A | 9/1999 | Wang |
| 5,997,568 | A | 12/1999 | Liu |
| 6,005,019 | A | 12/1999 | Liu |
| 6,075,118 | A | 6/2000 | Wang |
| 6,093,792 | A | 7/2000 | Gross |
| 6,111,060 | A | 8/2000 | Gruber |
| 6,114,017 | A | 9/2000 | Fabbricante |
| 6,117,928 | A | 9/2000 | Hiltunen |
| 6,121,170 | A | 9/2000 | Tsai |
| 6,127,485 | A | 10/2000 | Klun |
| 6,143,863 | A | 11/2000 | Gruber |
| 6,183,670 | B1 | 2/2001 | Torobin |
| 6,196,752 | B1 | 3/2001 | Komiyama |
| 6,197,237 | B1 | 3/2001 | Tsai |
| 6,232,280 | B1 | 5/2001 | Shah |
| 6,261,677 | B1 | 7/2001 | Tsai |
| 6,262,180 | B1 | 7/2001 | Klun |
| 6,306,782 | B1 | 10/2001 | Tsai |
| 6,315,806 | B1 | 11/2001 | Torobin |
| 6,342,566 | B2 | 1/2002 | Burkhardt |
| 6,382,526 | B1 | 5/2002 | Reneker |
| 6,384,142 | B1 | 5/2002 | Burkhardt |
| 6,482,341 | B1 | 11/2002 | Jongboom |
| 6,506,873 | B1 | 1/2003 | Ryan |
| 6,515,054 | B1 | 2/2003 | Matsushita |
| 6,645,618 | B2 | 11/2003 | Hobbs |
| 6,743,273 | B2 | 6/2004 | Chung |
| 6,787,493 | B1 | 9/2004 | Nagaoka |
| 6,800,226 | B1 | 10/2004 | Gerking |
| 6,861,025 | B2 | 3/2005 | Erickson |
| 6,916,752 | B2 | 7/2005 | Berrigan |
| 6,960,642 | B2 | 11/2005 | Jariwala |
| 7,199,197 | B2 | 4/2007 | Caldwell |
| 7,241,838 | B2 | 7/2007 | Shelby |
| 7,604,859 | B2 | 10/2009 | Liu |
| 7,623,339 | B2 | 11/2009 | Takahashi |
| 8,721,943 | B2 | 5/2014 | Moore et al. |
| 8,858,986 | B2 | 10/2014 | Scholz et al. |
| 8,932,704 | B2 | 1/2015 | Porbeni et al. |
| 2004/0024141 | A1 | 2/2004 | Hasebe |
| 2004/0045145 | A1 | 3/2004 | Wang |
| 2004/0241216 | A1 | 12/2004 | Klun |
| 2004/0265516 | A1 | 12/2004 | Schulz |
| 2005/0048152 | A1 | 3/2005 | Gerking |
| 2006/0058470 | A1 | 3/2006 | Rizk |
| 2006/0084340 | A1 | 4/2006 | Bond |
| 2006/0273495 | A1 | 12/2006 | Topolkaraev |
| 2006/0276092 | A1 | 12/2006 | Topolkaraev |
| 2007/0270071 | A1 | 11/2007 | Greer |
| 2008/0038976 | A1 | 2/2008 | Berrigan |
| 2008/0086199 | A1 | 4/2008 | Dave |
| 2008/0142023 | A1 | 6/2008 | Schmid |
| 2008/0160861 | A1 | 7/2008 | Berrigan |
| 2008/0200890 | A1* | 8/2008 | Wood et al. ..... 604/360 |
| 2008/0213595 | A1 | 9/2008 | Levitt |
| 2011/0151737 | A1 | 6/2011 | Moore et al. |
| 2011/0189463 | A1 | 8/2011 | Moore et al. |
| 2012/0077886 | A1 | 3/2012 | Scholz et al. |
| 2012/0088424 | A1 | 4/2012 | Eric et al. |
| 2014/0210141 | A1 | 7/2014 | Moore et al. |
| 2015/0004866 | A1 | 1/2015 | Scholz et al. |

FOREIGN PATENT DOCUMENTS

| | | | |
|---|---|---|---|
| EP | 669358 | 8/1995 | |
| EP | WO 01/14621 | * 3/2001 | ..... D01F 6/92 |
| EP | 1200661 | 7/2004 | |
| EP | 1097967 | 12/2004 | |
| EP | 1721927 | 11/2006 | |
| EP | 1862507 | 12/2007 | |
| JP | 61-66943 | 6/1994 | |
| JP | 2006-028726 | 2/2006 | |
| JP | 2007-197857 | 8/2007 | |
| JP | 4-319169 | 8/2009 | |
| KR | 10-1999-0076593 | 7/1997 | |
| KR | 10-0640138 | 10/2006 | |
| WO | WO 84-04311 | 11/1984 | |
| WO | WO 94-07941 | 4/1994 | |
| WO | WO 94-07949 | 4/1994 | |
| WO | WO 96-22330 | 7/1996 | |
| WO | WO 97-19991 | 6/1997 | |
| WO | WO 98-24951 | 6/1998 | |
| WO | WO 98-50611 | 11/1998 | |
| WO | WO 99-06456 | 2/1999 | |
| WO | WO 99-50345 | 10/1999 | |
| WO | WO 00-12606 | 3/2000 | |
| WO | WO 01-09425 | 2/2001 | |
| WO | WO 01/14621 | 3/2001 | |
| WO | WO 02/46504 | 6/2002 | |
| WO | WO 03-40201 | 5/2003 | |
| WO | WO 2006-130211 | 12/2006 | |
| WO | WO 2008-038350 | 4/2008 | |
| WO | WO 2009/027877 | 3/2009 | |
| WO | WO 2009-152345 | 12/2009 | |
| WO | WO 2009-152349 | 12/2009 | |
| WO | WO 2010-021911 | 2/2010 | |
| WO | WO 2010-117612 | 10/2010 | |
| WO | WO 2011-075619 | 6/2011 | |
| WO | WO 2011-084670 | 7/2011 | |
| WO | WO 2014/059239 A1 | 4/2014 | |

OTHER PUBLICATIONS

Resconi, "Selectivity in Propene Polymerization with Metallocene Catalysts" Chem. Rev., Mar. 25, 2000, vol. 100, pp. 1253-1345.

Scheirs, "Metallocene-based Polyolefins", vol. 1 and "Polyolefins", vol. 2, 2000, Wiley & Sons, Chichester, England, 10 pages.

Schmack, "High-Speed Melt Spinning of Various Grades of Polylactides", Journal of Applied Polymer Science,2004, vol. 91, pp. 800-806.

Solarski, "Characterization of the thermal properties of PLA fibers by modulated differential scanning calorimetry", Polymer, 2005, vol. 46, No. 25, pp. 11187-11192.

Takasaki, "Structural Development of Polylactides with Various d-Lactide contents in the High-Speed Melt Spinning Process", Journal of Macromolecular Science, *Part B-Physics*, 2003, vol. B42, No. 1, pp. 57-73.

Tsuji, "Stereocomplex formation between enantiomeric poly(lactic acid)s. XI. Mechanical properties and morphology of solution-cast films", Polymer, 1999, vol. 40, pp. 6699-6708.

Wente, "Manufacture of Superfine Organic Fibers", Report No. 4364 of the Naval Research Laboratories, Washington, D.C., May 25, 1954, 22 pages.

Wente, "Superfine Thermoplastic Fibers", Industrial and Engineering Chemistry, 1956, vol. 48, pp. 1342-1346.

Ziabicki, "Fundamentals of Fibre Formation: The Science of Fibre Spinning and Drawing", John Wiley & Sons, 1976, 3 pages.

(56) References Cited

OTHER PUBLICATIONS

International Search Report, PCT/US2009/047057, Date mailed Jul. 31, 2009, 3 pages.
International Search Report, PCT/US2009/047064, Date mailed Aug. 25, 2009, 5 pages.
International Search Report, PCT/US2010/028263, Date mailed Dec. 3, 2010, 4 pages.
U.S. Appl. No. 62/069,934, filed Oct. 29, 2014, Chakravarty et al.

* cited by examiner

DIMENSIONALLY STABLE NONWOVEN FIBROUS WEBS, AND METHODS OF MAKING AND USING THE SAME

CROSS REFERENCE TO RELATED APPLICATIONS

This application is a national stage filing under 35 U.S.C. 371 of PCT/US2011/056257, filed Oct. 14, 2011, which claims priority to U.S. Provisional Application No. 61/393,352, filed Oct. 14, 2010, the disclosures of which are incorporated by reference in their entirety herein.

BACKGROUND

Polyesters such as poly(ethylene) terephthalate (PET) and polyolefins such as poly(propylene) (PP) are two commonly used classes of petroleum based polymers in the commercial production of textile fibers, packaging films, beverage bottles, and injection molded goods by processes such as BMF and spunbond. Although PET has a higher melting point and superior mechanical and physical properties compared to other commercially useful polymers, it exhibits poor dimensional stability at temperatures above its glass transition temperature. Polyester fibers, e.g. aromatic polyesters such as PET and poly(ethylene) terephthalate glycol (PETG), and/or aliphatic polyesters such as poly(lactic acid) (PLA), and webs including such fibers, may shrink up to 40% of the original length when subjected to elevated temperatures due to the relaxation of the oriented amorphous segments of the molecules to relax upon exposure to heat (See Narayanan, V.; Bhat, G. S, and L. C. Wadsworth. *TAPPI Proceedings: Nonwovens Conference & Trade Fair*. (1998) 29-36).

Furthermore, PET has generally not been considered as suitable for applications involving high-speed processing because of its slow crystallization from the melt state; at commercial production rates, the polymer has minimal opportunity to form well developed crystallites. Articles prepared from PET fibers typically need to undergo an additional stage of drawing and heat-setting (e.g. annealing) during the fiber spinning process to dimensionally stabilize the produced structure.

Additionally, there is also a growing interest in replacing petroleum based polymers, such as PET and polypropylene (PP), with resource renewable polymers, i.e. polymers derived from plant based materials. Ideal resource renewable polymers are "carbon dioxide neutral" meaning that as much carbon dioxide is consumed in growing the plants base material as is given off when the product is made and disposed of Biodegradable materials have adequate properties to permit them to break down when exposed to conditions which lead to composting. Examples of materials thought to be biodegradable include aliphatic polyesters such as poly(lactic acid) (PLA), poly(glycolic acid), poly (caprolactone), copolymers of lactide and glycolide, poly (ethylene succinate), and combinations thereof.

However, difficulty is often encountered in the use of aliphatic polyesters such as poly(lactic acid) due to aliphatic polyester thermoplastics having relatively high melt viscosities which yields nonwoven webs that generally cannot be made at the same fiber diameters that polypropylene can on standard nonwoven production equipment. The coarser fiber diameters of polyester webs can limit their application as many final product properties are controlled by fiber diameter. For example, course fibers lead to a noticeably stiffer and less appealing feel for skin contact applications. Furthermore, course fibers produce webs with larger porosity that can lead to webs that have less of a barrier property, e.g. less repellency to aqueous fluids.

The processing of aliphatic polyesters as microfibers has been described in U.S. Pat. No. 6,645,618 (Hobbs et al.) and U.S. Pat. No. 6,645,618. U.S. Pat. No. 6,111,160 (Gruber et. al.) discloses the use of melt stable polylactides to form nonwoven articles via melt blown and spunbound processes. JP6466943A (Shigemitsu et al.) describes a low shrinkage-characteristic polyester system and its manufacture approach. U.S. Patent Application Publication No. 2008/0160861 (Berrigan et al.) describes a method for making a bonded nonwoven fibrous web comprising extruding melt blown fibers of a polyethylene terephthalate and polylactic acid, collecting the melt blown fibers as an initial nonwoven fibrous web, and annealing the initial nonwoven fibrous web with a controlled heating and cooling operation. U.S. Pat. No. 5,364,694 (Okada et al.) describes a polyethylene terephthalate (PET) based meltblown nonwoven fabric and its manufacture. U.S. Pat. No. 5,753,736 (Bhat et al.) describes the manufacture of polyethylene terephthalate fiber with reduced shrinkage through the use of nucleation agent, reinforcer and a combination of both.

However, difficulty is often encountered in the use of aliphatic polyesters such as poly(lactic acid) for BMF due to aliphatic polyester thermoplastics having relatively high melt viscosities which yields nonwoven webs that generally cannot be made at the same fiber diameters that polypropylene can. The coarser fiber diameters of polyester webs can limit their application as many final product properties are controlled by fiber diameter. For example, course fibers lead to a noticeably stiffer and less appealing feel for skin contact applications. Furthermore, course fibers produce webs with larger porosity that can lead to webs that have less of a barrier property, e.g. less repellency to aqueous fluids.

The processing of aliphatic polyesters as microfibers has been described in U.S. Pat. No. 6,645,618 (Hobbs et al.). U.S. Pat. No. 6,111,160 (Gruber et al.) discloses the use of melt stable polylactides to form nonwoven articles via melt blown and spunbound processes. JP6466943A (Shigemitsu et al.) describes a low shrinkage-characteristic polyester system and its manufacture approach. U.S. Patent Application Publication No. 2008/0160861 (Berrigan et al.) describes a method for making a bonded nonwoven fibrous web comprising extruding melt blown fibers of a polyethylene terephthalate and polylactic acid, collecting the melt blown fibers as an initial nonwoven fibrous web, and annealing the initial nonwoven fibrous web with a controlled heating and cooling operation. U.S. Pat. No. 5,364,694 (Okada et al.) describes a polyethylene terephthalate (PET) based meltblown nonwoven fabric and its manufacture. U.S. Pat. No. 5,753,736 (Bhat et al.) describes the manufacture of polyethylene terephthalate fiber with reduced shrinkage through the use of nucleation agent, reinforcer and a combination of both. U.S. Pat. Nos. 5,585,056 and 6,005,019 describe a surgical article comprising absorbable polymer fibers and a plasticizer containing stearic acid and its salts. U.S. Pat. No. 6,515,054 describes a biodegradable resin composition comprising a biodegradable resin, a filler, and an anionic surfactant.

U.S. Pat. Nos. 5,585,056 and 6,005,019 describe a surgical article comprising absorbable polymer fibers and a plasticizer containing stearic acid and its salts.

Thermoplastic polymers are widely employed to create a variety of products, including blown and cast films, extruded sheets, foams, fibers, monofilament and multifilament yarns, and products made therefrom, woven and knitted fabrics, and non-woven fibrous webs. Traditionally, many of these articles have been made from petroleum-based thermoplastics such as polyolefins.

Degradation of aliphatic polyesters can occur through multiple mechanisms including hydrolysis, transesterification, chain scission, and the like. Instability of such polymers during processing can occur at elevated temperatures as described in WO94/07941 (Gruber et al.).

Many thermoplastic polymers used in these products, such as polyhydroxyalkanoates (PHA), are inherently hydrophobic. That is, as a woven, knit, or nonwoven, they will not absorb water. There are a number of uses for thermoplastic polymers where their hydrophobic nature either limits their use or requires some effort to modify the surface of the shaped articles made therefrom. For example, polylactic acid has been reported to be used in the manufacture of nonwoven webs that are employed in the construction of absorbent articles such as diapers, feminine care products, and personal incontinence products (U.S. Pat. No. 5,910,368). These materials were rendered hydrophilic through the use of a post treatment topical application of a silicone copolyol surfactant. Such surfactants are not thermally stable and can break down in an extruder to yield formaldehyde.

U.S. Pat. No. 7,623,339 discloses a polyolefin resin rendered antimicrobial and hydrophilic using a combination of fatty acid monoglycerides and enhancer(s).

Coating methods to provide a hydrophilic surface are known, but also have some limitations. First of all, the extra step required in coating preparation is expensive and time consuming. Many of the solvents used for coating are flammable liquids or have exposure limits that require special production facilities. The quantity of surfactant can also be limited by the solubility of the surfactant in the coating solvent and the thickness of the coating.

Post treatment of the thermoplastic polymer can be undesirable for at least two other reasons. First, it can be more expensive since it requires additional processing steps of surfactant application and drying. Second, PHAs are polyesters, and thus prone to hydrolysis. It is desirable to limit the exposure of PHA polymers to water which can be present in the surfactant application solution. Furthermore, the subsequent drying step at elevated temperature in the wet web is highly undesirable.

SUMMARY

The present disclosure relates to dimensionally stable nonwoven fibrous webs and methods of making and using such webs. The disclosure further relates to dimensionally stable nonwoven fibrous webs including blends of polypropylene and an aliphatic and/or aromatic polyester useful in making articles, such as biodegradable and biocompatible articles.

In one aspect, the disclosure relates to a web including a plurality of fibers comprising one or more thermoplastic polyesters selected from aliphatic polyesters and aromatic polyesters; and an antishrinkage additive in an amount greater than 0% and no more than 10% by weight of the web, wherein the fibers exhibit molecular orientation, wherein at least a portion of the fibers are staple fibers, and further wherein the web has at least one dimension which decreases by no greater than 10% in the plane of the web when the web is heated to a temperature above a glass transition temperature of the fibers, but below the melting point of the fibers in an unrestrained condition.

In another aspect, the disclosure relates to a web including a plurality of fibers comprising one or more thermoplastic polyesters selected from aliphatic polyesters and aromatic polyesters; and an antishrinkage additive in an amount greater than 0% and no more than 25% by weight of the web, an anionic surfactant (as described further below), and further wherein the web has at least one dimension which decreases by no greater than 12% in the plane of the web when the web is heated to a temperature above a glass transition temperature of the fibers, but below the melting point of the fibers in an unrestrained condition.

In some exemplary embodiments, the molecular orientation of the fibers results in a bi-refringence value of at least 0.01.

In some exemplary embodiments, the thermoplastic polyester comprises at least one aromatic polyester. In certain exemplary embodiments, the aromatic polyester is selected from poly(ethylene)terephthalate (PET), poly(ethylene)terephthalate glycol (PETG), poly(butylene)terephthalate (PBT), poly(trimethyl)terephthalate (PTT), their copolymers, or combinations thereof. In other exemplary embodiments, the thermoplastic polyester comprises at least one aliphatic polyester. In certain exemplary embodiments, the aliphatic polymer is selected from one or more poly(lactic acid), poly(glycolic acid), poly(lactic-co-glycolic acid), polybutylene succinate, polyethylene adipate, polyhydroxybutyrate, polyhydroxyvalerate, blends, and copolymers thereof. In certain exemplary embodiments, the aliphatic polyester is semicrystalline.

In certain embodiments the thermoplastic antishrinkage additive comprises at least one thermoplastic semicrystalline polymer selected from the group consisting of polyethylene, linear low density polyethylene, polypropylene, polyoxymethylene, poly(vinylidine fluoride), poly(methyl pentene), poly(ethylene-chlorotrifluoroethylene), poly(vinyl fluoride), poly(ethylene oxide), poly(ethylene terephthalate), poly(butylene terephthalate), semicrystalline aliphatic polyesters including polycaprolactone, aliphatic polyamides such as nylon 6 and nylon 66, and thermotropic liquid crystal polymers. Particularly preferred thermoplastic antishrinkage polymers include polypropylene, nylon 6, nylon 66, polycaprolactone, and polyethylene oxides. In most embodiments, the fibers are microfibers, particularly fibers.

In additional exemplary embodiments related to both of the previously described aspects of the disclosure, the plurality of fibers may comprise a thermoplastic polymer distinct from the thermoplastic polyester. In further exemplary embodiments, the fibers may comprise at least one of a plasticizer, a diluent, a surfactant, a viscosity modifier, an antimicrobial component, or combinations thereof. In some particular exemplary embodiments, the fibers exhibit a median fiber size of no greater than about 200 denier. In certain of these embodiments, the fibers exhibit a median fiber size of no greater than 100 denier. In other embodiments, the fibers exhibit a median fiber size of no greater than 32 denier. In certain of these embodiments, the fibers exhibit a median fiber diameter of at least 10 denier. In additional exemplary embodiments, the web is biocompatible.

The present disclosure is also directed to fibers of aliphatic polyesters, articles made with the fibers, and a method for making the aliphatic polyester fibers. The fibers may have utility in a variety of food safety, medical, personal hygiene, disposable and reusable garments, and water purification applications.

The nonwoven web can be made with a blend of fibers, one of which comprises the aliphatic polyester. The staple fibers can form a nonwoven web such as by carding or entanglement for one time or limited use applications as wipes. Alternatively aliphatic polyester fibers could be woven in whole or in part into a wipe product which could be used for longer periods. Additional fibers that could be blended in with the aliphatic polyesters include fibers to increase absorbency or other properties include fibers based on polyolefins, polyesters, acrylates, superabsorbent fibers, and natural fibers such as bamboo, soy bean, agave, coco, rayon, cellulosics, wood pulp or cotton.

Nonwoven webs of the aliphatic polyester can be prepared using fibers or filaments cut to desired lengths and further processed into nonwoven webs using various known web forming processes, such as carding. In such cases the chopped fibers may be blended with other fibers in the web forming process. Alternatively fibers or filaments prepared with the aliphatic polyester could be woven alone or in combination with other fibers.

In a further aspect, the disclosure relates to a method of making a dimensionally stable nonwoven fibrous web comprising forming a mixture of one or more thermoplastic polyesters selected from aliphatic polyesters and aromatic polyesters with polypropylene in an amount greater than 0% and no more than 10% by weight of the mixture; forming a plurality of fibers from the mixture; and collecting at least a portion of the fibers to form a web, wherein the fibers exhibit molecular orientation, and further wherein the web has at least one dimension in the plane of the web which decreases by no greater than 12% when the web is heated to a temperature above a glass transition temperature of the fibers, but below the melting point of the fibers when measured with the web in an unrestrained condition. In some exemplary embodiments, the methods may further comprise post heating the dimensionally stable nonwoven fibrous web, for example, by controlled heating or cooling of the web.

In a further aspect, the disclosure relates to an article comprising a dimensionally stable nonwoven fibrous web as described above, wherein the article is a wipe.

Exemplary aliphatic polyesters are poly(lactic acid), poly (glycolic acid), poly(lactic-co-glycolic acid), polybutylene succinate, polyhydroxybutyrate, polyhydroxyvalerate, blends, and copolymers thereof.

Articles made with the fibers comprise molded polymeric articles, polymeric sheets, polymeric fibers, woven webs, nonwoven webs, porous membranes, polymeric foams, layered fibers, composite webs, and combinations thereof made of the fibers described herein including thermal or adhesive laminates. Products such as medical gowns, medical drapes, sterilization wraps, wipes, absorbents, insulation, and filters can be made from fibers of aliphatic polyesters, such as PLA. Films, membranes, nonwovens, scrims and the like can be extrusion bonded or thermally laminated directly to the webs.

Exemplary embodiments of the dimensionally stable nonwoven fibrous webs according to the present disclosure may have structural features that enable their use in a variety of applications, have exceptional absorbent properties, exhibit high porosity and permeability due to their low solidity, and/or be manufactured in a cost-effective manner. The webs may have a soft feel similar to polyolefin webs but in many cases exhibit superior tensile strength due to the higher modulus of the aliphatic polyester used.

Bi-component fibers, such as core-sheath or side-by-side bi-component fibers, may be prepared, as may be bicomponent microfibers, including sub-micrometer fibers. However, exemplary embodiments of the disclosure may be particularly useful and advantageous with monocomponent fibers. Among other benefits, the ability to use monocomponent fibers reduces complexity of manufacturing and places fewer limitations on use of the web.

Exemplary methods of producing dimensionally stable nonwoven fibrous webs according to the present disclosure may have advantages in terms of higher production rate, higher production efficiency, lower production cost, and the like.

Blends may be made using a variety of other polymers including aromatic polyesters, aliphatic/aromatic copolyesters such as those described in U.S. Pat. No. 7,241,838 which is incorporated herein by reference, cellulose esters, cellulose ethers, thermoplastic starches, ethylene vinyl acetate, polyvinyl alcohol, ethylenevinyl alcohol, and the like. In blended compositions which include thermoplastic polymers which are not aliphatic polyesters, the aliphatic polyester is typically present at a concentration of greater than 70% by weight of total thermoplastic polymer, preferably greater than 80% by weight of total thermoplastic polymer and most preferably greater than about 90% by weight of thermoplastic polymer.

The present disclosure is also directed to a composition, article and method for making a durable hydrophilic and preferably biocompatible composition. The composition and articles comprise the thermoplastic polyesters and the surfactants as described herein. The method comprises providing the thermoplastic polyesters and the surfactants as described herein, and mixing these materials sufficiently to yield a biocompatible, durable hydrophilic composition.

In another aspect, the polymer is solvent soluble or dispersible and the composition may be solvent cast, solvent spun to form films or fibers, or foams.

The composition of aliphatic polyesters and surfactants exhibit durable hydrophilicity. In some cases the surfactant may be dissolved in or along with a surfactant carrier. The surfactant carrier and/or surfactant may be a plasticizer for the thermoplastic aliphatic polyester.

The compositions of this invention are "relatively homogenous". That is, the compositions can be produced by melt extrusion with good mixing and at the time of extrusion would be relatively homogenous in concentration throughout. It is recognized, however, that over time and/or with heat treatment the surfactant(s) may migrate to become higher or lower in concentration at certain points, such as at the surface of the fiber.

The hydrophilicity imparted to the fiber compositions described herein is done using at least one melt additive surfactant. Suitable anionic surfactants include alkyl, alkenyl, alkaryl, or arakyl sulfate, alkyl, alkenyl, alkaryl, or arakyl sulfonate, alkyl, alkenyl alkaryl, or arakyl phosphate, alkyl, alkenyl, alkaryl, or arakyl carboxylate or a combination thereof. The alkyl and alkenyl groups may be linear or branched. These surfactants may be modified as is known in the art. For example, as used herein an "alkyl carboxylate" is a surfactant having an alkyl group and a carboxylate group but it may also include, for example, bridging moieties such as polyalkylene oxide groups, e.g., isodeceth-7 carboxylate sodium salt is an alkyl carboxylate having a branched chain of ten carbons (C10) alkyl group, seven moles of ethylene oxide and terminated in a carboxylate.

Various aspects and advantages of exemplary embodiments of the present invention have been summarized. The above Summary is not intended to describe each illustrated embodiment or every implementation of the present invention. The Detailed Description and the Examples that follow more particularly exemplify certain presently preferred embodiments using the principles disclosed herein.

DETAILED DESCRIPTION

The present disclosure relates generally to dimensionally stable nonwoven fibrous webs or fabrics. The webs include a plurality of fibers formed from a (co)polymer mixture that is preferably melt processable, such that the (co)polymer mixture is capable of being extruded. Dimensionally stable nonwoven fibrous webs may be prepared by blending an aliphatic and/or aromatic polyester with polypropylene (PP) in an amount greater than 0% and no more than 10% by weight of the web, before or during extrusion. The resulting webs have at least one dimension which decreases by no greater than 10% in the plane of the web, when the web is heated to a temperature above a glass transition temperature of the fibers while in an unrestrained condition. In certain embodiments, the fibers exhibit molecular orientation.

In the plane of the web refers to the x-y plane of the web, which may also be referred to as the machine direction and/or cross direction of the web. Thus, fibers and webs described herein have at least one dimension in the plane of the web, e.g., the machine or the cross direction, that decreases by no greater than 10%, when the web is heated to a temperature above a glass transition temperature of the fibers.

The fibrous webs or fabrics as described herein are dimensionally stable when the web is heated to a temperature above a glass transition temperature of the fibers. The webs may be heated 15° C., 20° C., 30° C., 45° C. and even 55° C. above the glass transition temperature of the aromatic and/or aliphatic polyester fibers, and the web will remain dimensionally stable, e.g., having at least one dimension which decreases by no greater than 12% in the plane of the web. The web should not be heated to a temperature that melts the fibers, or causes the fibers to appreciably degrade, as demonstrated by such characteristics as loss of molecular weight or discoloration.

While not intending to be bound by theory, it is believed that aggregates of PP may thereby be evenly distributed through the core of the filament; the polyolefin is believed to act as a selectively miscible additive. At low weight percents of the web, PP mixes with the polyester and physically inhibits chain movement, thereby suppressing cold crystallization, and macroscopic shrinkage is not observed.

In some embodiments, the weight percent of the PP may be increased above 10 weight percent in the presence of a compatibilizer. While not intending to be bound by theory, the compatibilizer functions to render the PP and polyester phase more compatible. Compatibilizers can include a combination of additives, such as a plasticizer/surfactant combination. An exemplary compatibilizer is PEG-DOSS, which may allow amounts of PP or other antishrinkage additives, up to 25% by weight of the fibrous web.

In one preferred embodiment, the method of the present disclosure comprises providing the aliphatic polyesters and the antishrink additive as described herein, and processing these materials sufficiently to yield a web of fibers. The compositions are preferably non-irritating and non-sensitizing to mammalian skin and biodegradable. The aliphatic polyester generally has a lower melt processing temperature and can yield a more flexible output material.

In another preferred embodiment the present invention discloses the use of melt additive anionic surfactants, optionally combined with surfactant carriers such as polyethylene glycol, to impart stable durable hydrophilicity to aliphatic polyester thermoplastics such as polyhydroxyalkanoates (e.g. polylactic acid). Embodiments comprising the anionic surfactants described herein are particularly useful for making hydrophilic absorbent polylactic acid nonwoven web articles, such as wet or dry wipes. Wet wipes include disinfecting wipes, scrubby disinfecting wipes, disposable floor cloths, premium surface wipes, general cleaning wipes, and glass cleaning wipes. Dry wipes include floor wipes, hand dusting wipes, and pet hair wipes. The dimensionally stable fibrous webs described herein may be suitable for use as wipes as further described in Applicants' co-pending PCT Patent Publication No. WO 2010/021911 A1.

Hydrophilicity, or the lack thereof, can be measured in a variety of ways. For example, when water contacts a porous nonwoven web that is hydrophobic or has lost its hydrophilicity, the water does not flow, or flows undesirably slowly, through the web. Importantly the fibers and webs of the present invention exhibit stable hydrophilicity (water absorbency). That is, they remain hydrophilic after aging in a clean but porous enclosure such as a poly/Tyvek pouch for over 30 days at 23° C. or lower and preferably for over 40 days.

Preferred materials of this invention wet with water and thus have an apparent surface energy of great than 72 dynes/cm (surface tension of pure water). The most preferred materials of this invention instantly absorb water and remain water absorbent after aging for 10 days at 5° C., 23° C. and 45° C. More preferred materials of this invention instantly absorb water and remain water absorbent after aging for 20 days at 5° C., 23° C. and 45° C. Even more materials of this invention instantly absorb water and remain water absorbent after aging for 30 days at 5° C., 23° C. and 45° C.

The preferred fabrics are instantaneously wettable and absorbent and are capable of absorbing water at very high initial rates.

For the following defined terms, these definitions shall be applied, unless a different definition is given in the claims or elsewhere in the specification.

The term "antishrinkage" additive refers to a thermoplastic polymeric additive which, when added to the aliphatic polyester in a concentration less no greater than 12% by weight of the aliphatic polyester, and formed into a nonwoven web, results in a web having at least one dimension which decreases by no greater than 12% in the plane of the web when the web is heated to a temperature above a glass transition temperature of the fibers, but below the melting point of the fibers. Preferred antishrinkage additives form a dispersed phase of discrete particulates in the aliphatic polyester when cooled to 23-25° C. Most preferred antishrinkage additives are semicrystalline polymers as determined by differential scanning calorimetry. The fiber webs can be measured for shrinkage by placing 10 cm×10 cm squares of the web on aluminum trays in an oven at 80° C. for approximately 14 hours.

The term "biodegradable" means degradable by the action of naturally occurring microorganisms such as bacteria, fungi and algae and/or natural environmental factors such as hydrolysis, transesterification, exposure to ultraviolet or visible light (photodegradable) and enzymatic mechanisms or combinations thereof.

The term "biocompatible" means biologically compatible by not producing toxic, injurious or immunological response in living tissue. Biocompatible materials may also be broken down by biochemical and/or hydrolytic processes and absorbed by living tissue. Test methods used include ASTM F719 for applications where the fibers contact tissue such as skin, wounds, mucosal tissue including in an orifice such as the esophagus or urethra, and ASTM F763 for applications where the fibers are implanted in tissue.

The term "bi-component fiber" or "multi-component fiber" means fibers with two or more components, each component occupying a part of the cross-sectional area of the fiber and extending over a substantial length of the fiber. Suitable multi-component fiber configurations include, but are not limited to, a sheath-core configuration, a side-by-side configuration, and an "islands-in-the-sea" configuration (for example, fibers produced by Kuraray Company, Ltd., Okayama, Japan).

The term "monocomponent fiber" means fibers in which the fibers have essentially the same composition across their cross-section, but monocomponent includes blends or additive-containing materials, in which a continuous phase of substantially uniform composition extends across the cross-section and over the length of the fiber. Fibers made of blends in which the additive is heterogeneiously dispersed in the polymer phase both across the cross section and along the fiber length is considered a monocomponent fiber.

The term "durable hydrophilic" means that the composition, typically in fiber or fabric form, remains water absorbent when aged at least 30 days at 23° C. and preferably at least 40 days at 23° C.

The term "median fiber diameter" means fiber diameter determined by producing one or more images of the fiber structure, such as by using a scanning electron microscope; measuring the fiber diameter of clearly visible fibers in the one or more images resulting in a total number of fiber diameters, x; and calculating the median fiber diameter of the x fiber diameters. Typically, x is greater than about 20, more preferably greater than about 50, and desirably ranges from about 50 to about 200.

The term "fiber" generally refers to fibers having a median fiber size of no greater than about 200 denier, preferably no greater than 100 denier, more preferably no greater than 32 denier.

"Continuous oriented fibers" herein refers to essentially continuous fibers issuing from a die and traveling through a processing station in which the fibers are drawn and at least portions of the molecules within the fibers are oriented into alignment with the longitudinal axis of the fibers ("oriented" as used with respect to fibers means that at least portions of the molecules of the fibers are aligned along the longitudinal axis of the fibers).

"Molecularly same" polymer refers to polymers that have essentially the same repeating molecular unit, but which may differ in molecular weight, method of manufacture, commercial form, etc.

"Self supporting" or "self sustaining" in describing a web means that the web can be held, handled and processed by itself, e.g., without support layers or other support aids.

"Solidity" is a nonwoven web property inversely related to density and characteristic of web permeability and porosity (low Solidity corresponds to high permeability and high porosity), and is defined by the equation:

$$\text{Solidity (\%)}=[3.937*\text{Web Basis Weight (g/m2)}][\text{Web Thickness (mils)}*\text{Bulk Density (g/cm}^3)]$$

"Web Basis Weight" is calculated from the weight of a 10 cm×10 cm web sample.

"Web Thickness" is measured on a 10 cm×10 cm web sample using a thickness testing gauge having a tester foot with dimensions of 5 cm×12.5 cm at an applied pressure of 150 Pa.

"Bulk Density" is the bulk density of the polymer or polymer blend that makes up the web, taken from the literature.

"Web" as used herein generally is a network of entangled fibers forming a sheet like or fabric like structure.

"Nonwoven" generally refers to fabric consisting of an assembly of polymeric fibers (oriented in one direction or in a random manner) held together (1) by mechanical interlocking; (2) by fusing of thermoplastic fibers; (3) by bonding with a suitable binder such as a natural or synthetic polymeric resin; or (4) any combination thereof.

As used in this specification and the appended claims, the singular forms "a", "an", and "the" include plural referents unless the content clearly dictates otherwise. Thus, for example, reference to fibers containing "a compound" includes a mixture of two or more compounds. As used in this specification and the appended claims, the term "or" is generally employed in its sense including "and/or" unless the content clearly dictates otherwise.

As used in this specification, the recitation of numerical ranges by endpoints includes all numbers subsumed within that range (e.g. 1 to 5 includes 1, 1.5, 2, 2.75, 3, 3.8, 4, and 5).

Unless otherwise indicated, all numbers expressing quantities or ingredients, measurement of properties and so forth used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings of the present invention. At the very least, and not as an attempt to limit the application of the doctrine of equivalents to the scope of the claims, each numerical parameter should at least be construed in light of the number of reported significant digits and by applying ordinary rounding techniques.

Various exemplary embodiments of the disclosure will now be described. Exemplary embodiments of the present invention may take on various modifications and alterations without departing from the spirit and scope of the disclosure. Accordingly, it is to be understood that the embodiments of the present invention are not to be limited to the following described exemplary embodiments, but is to be controlled by the limitations set forth in the claims and any equivalents thereof.

Reference throughout this specification to "one embodiment," "certain embodiments," "one or more embodiments" or "an embodiment," whether or not including the term "exemplary" preceding the term "embodiment," means that a particular feature, structure, material, or characteristic described in connection with the embodiment is included in at least one embodiment of the present invention. Thus, the appearances of the phrases such as "in one or more embodiments," "in certain embodiments," "in one embodiment" or "in an embodiment" in various places throughout this specification are not necessarily referring to the same embodiment of the present invention. Furthermore, the particular features, structures, materials, or characteristics may be combined in any suitable manner in one or more embodiments.

A. Dimensionally Stable Nonwoven Fibrous Webs

In some embodiments, dimensionally stable nonwoven webs may be formed from a molten mixture of a thermoplastic polyester and a polypropylene. In certain embodiments, the dimensionally stable nonwoven webs may be a carded web, airlaid, wetlaid, or combinations thereof. These webs may be post processed into other forms. For example, they may be embossed, apertured, perforated, microcreped, laminated, etc. in order to provide additional properties. It is particularly advantageous that post processing thermal processes can be accomplished without shrinkage or loss of hydrophilicity on the fibrous webs.

In other embodiments, dimensionally stable continuous filaments and short cut staple fiber may be formed from a molten mixture of a thermoplastic aliphatic polyester and an antishrinkage additive. The filaments can be made into dimensionally stable webs via standard textile process (e.g. knitting or weaving). The short cut staple fiber can be made into dimensionally stable webs via standard web forming nonwoven processes (e.g. airlaid, wetlaid, carding, etc.). Bonding may be effected using, for example, thermal bonding, adhesive bonding, powder binder bonding, hydroentangling, needlepunching, calendaring, ultrasonics, or a combination thereof. One, two, three, or more layers of webs may be layered and processed with or without bonding the layers together. Layers may be bonded by needle tacking, adhesives, thermal calendaring, ultrasonic welding, stitch bonding, hydroentangling, and the like. Barrier films may be placed on or within these fabrics.

1. Molecularly Oriented Fibers

The dimensionally stable nonwoven fibrous webs can be prepared as staple fibers formed of a mixture of one or more thermoplastic polyesters selected from aliphatic and aromatic polyesters with antishrinkage additive, preferably in an amount greater than 0% and no more than 10% by weight of the mixture. The resulting webs have at least one dimension which decreases by no greater than 12% in the plane of the web when the web is heated to a temperature above a glass transition temperature of the fibers. The glass transition temperature of the fibers may be determined conventionally as is known in the art, for example, using differential scanning calorimetry (DSC), or modulated DSC. In certain exemplary embodiments, the thermoplastic polyester may be selected to include at least one aromatic polyester. In other exemplary embodiments, the aromatic polyester may be selected from PET, PETG, poly(butylene)terephthalate (PBT), poly(trimethyl)terephthalate (PTT), or combinations thereof.

As noted above, the fibers are preferably molecularly oriented; i.e., the fibers preferably comprise molecules that are aligned lengthwise of the fibers and are locked into (i.e., are thermally trapped into) that alignment. Oriented fibers are fibers where there is molecular orientation within the fiber. Fully oriented and partially oriented polymeric fibers are known and commercially available. Orientation of fibers can be measured in a number of ways, including birefringence, heat shrinkage, X-ray scattering, and elastic modulus (see e.g. Principles of Polymer Processing, Zehev Tadmor and Costas Gogos, John Wiley and Sons, New York, 1979, pp. 77-84). It is important to note that molecular orientation is distinct from crystallinity, as both crystalline and amorphous materials can exhibit molecular orientation independent from crystallization.

Oriented fibers may exhibit birefringence values that can be measured as described in Applicants' copending applications PCT/US2010/028263, filed Mar. 23, 2010; and U.S. Provisional Ser. Nos. 61/287,697 and 61/298,609, both filed Dec. 17, 2009. Properties of the oriented fibers may also exhibit differences in properties as measured by differential scanning calorimetry (DSC), as further described in Applicants' copending applications PCT/US2010/028263, filed Mar. 23, 2010; and U.S. Provisional Ser. Nos. 61/287,697 and 61/298,609, both filed Dec. 17, 2009. While not intending to be bound by theory, it is believed that molecular orientation is improved through the use of fiber attenuation as is known in the art (See U. W. Gedde, *Polymer Physics,* 1st Ed. Chapman & Hall, London, 1995, 298.) An increase in percent crystallinity of the attenuated fibers may thus be observed. The crystallites stabilize the filaments by acting as anchoring which inhibit chain motion, and rearrangement and crystallization of the rigid amorphous fraction; as the percentage of crystallinity is increased the rigid amorphous and amorphous fraction is decreased. Semi-crystalline, linear polymers consist of a crystalline and an amorphous phase with both phases being connected by tie molecules. The tie-molecule appears in both phases; strain builds at the coupled interface and it appears particularly obvious in the amorphous phase as observed in the broadening of the glass transition to higher temperatures in semi-crystalline polymers. In cases of strong coupling, the affected molecular segments are produce a separate intermediate phase of the amorphous phase called the rigid amorphous fraction. The intermediate phase, forming the extended boundary between the crystalline and amorphous phases, is characterized by lower local entropy than that of the fully amorphous phase.

At temperatures above the glass transition and below the melting temperature of the material, the rigid amorphous fraction rearranges and crystallizes; it undergoes cold crystallization. The percentages of crystalline and rigid amorphous material present in the fibers determine the macroscopic shrinkage value. The presence of crystallites may act to stabilize the filaments by acting as anchoring or tie points and inhibit chain motion.

The inventors have found that preferred aliphatic polyester fabrics such as those made from PLA have at least 20% crystallinity, preferably at least 30% crystallinity and most preferably at least 50% crystallinity in order to have optimum dimensional stability at elevated temperatures and mechanical properties such as tensile strength.

2. Fiber Sizes

In some exemplary embodiments, the fibrous webs of the present disclosure may comprise small denier size staple (1 d-15 d). These fibers can result in smaller pore sizes and more surface area appropriate for cleaning surfaces contaminated fine dust and dirt particles. In other embodiments the fibrous webs of the present disclosure may comprise larger denier size staple (15 d-200 d). These fibers can result in larger pore sizes and less surface area appropriate for cleaning surfaces contaminated with larger dirt particles such as sand, food crumbs, lawn debris, etc. Combinations of fibers of two or more average diameters also are possible. This can allow for precise adjustment of the porosity The fiber component may comprise monocomponent fibers comprising the above-mentioned polymers or copolymers (i.e. (co)polymers. In this exemplary embodiment, the monocomponent fibers may also contain additives as described below. Alternatively, the fibers formed may be multi-component fibers.

In other exemplary embodiments, the nonwoven fibrous webs of the present disclosure may comprise one or more fiber components of varying size.

3. Layered Structures

In other exemplary embodiments, a multi-layer nonwoven fibrous web may be formed by overlaying on a support layer a dimensionally stable dimensionally stable nonwoven fibrous web as described in Applicants' co-pending applications U.S. Provisional Ser. Nos. 61/287,697 and 61/298,609, both filed Dec. 17, 2009 and PCT Application PCT/US2010/028263, filed Mar. 23, 2010.

For any of the previously described exemplary embodiments of a dimensionally stable nonwoven fibrous web according to the present disclosure, the web will exhibit a basis weight, which may be varied depending upon the particular end use of the web. Typically, the dimensionally stable nonwoven fibrous web has a basis weight of no greater than about 1000 grams per square meter (gsm). In some embodiments, the nonwoven fibrous web has a basis weight of from about 1.0 gsm to about 500 gsm. In other embodiments, the dimensionally stable nonwoven fibrous web has a basis weight of from about 10 gsm to about 300 gsm.

As with the basis weight, the nonwoven fibrous web will exhibit a thickness, which may be varied depending upon the particular end use of the web. Typically, the dimensionally stable nonwoven fibrous web has a thickness of no greater than about 300 millimeters (mm). In some embodiments, the dimensionally stable nonwoven fibrous web has a thickness of from about 0.5 mm to about 150 mm. In other embodiments, the dimensionally stable nonwoven fibrous web has a thickness of from about 1.0 mm to about 50 mm.

5. Optional Support Layer

The dimensionally stable nonwoven fibrous webs of the present disclosure may further comprise a support layer. A multi-layer dimensionally stable nonwoven fibrous web structure may also provide sufficient strength for further processing, which may include, but is not limited to, winding the web into roll form, removing the web from a roll, molding, pleating, folding, stapling, weaving, and the like.

A variety of support layers may be used in the present disclosure. Suitable support layers include, but are not limited to, a nonwoven fabric, a woven fabric, a knitted fabric, a foam layer, a film, a paper layer, an adhesive-backed layer, a foil, a mesh, an elastic fabric (i.e., any of the above-described woven, knitted or nonwoven fabrics having elastic properties), an apertured web, an adhesive-backed layer, or any combination thereof. In one exemplary embodiment, the support layer comprises a polymeric nonwoven fabric. Suitable nonwoven polymeric fabrics include, but are not limited to, a spunbonded fabric, a meltblown fabric, a carded web of staple length fibers (i.e., fibers having a fiber length of no greater than about 100 mm), a needle-punched fabric, a split film web, a hydroentangled web, an airlaid staple fiber web, or a combination thereof. In certain exemplary embodiments, the support layer comprises a web of bonded staple fibers. As described further below, bonding may be effected using, for example, thermal bonding, ultrasonic bonding, adhesive bonding, powdered binder bonding, hydroentangling, needlepunching, calendering, or a combination thereof. A support layer or other optional additional layers may be present and have characteristics as further described in Applicants' co-pending applications U.S. Provisional Ser. Nos. 61/287,697 and 61/298,609, both filed Dec. 17, 2009 and PCT Application PCT/US2010/028263, filed Mar. 23, 2010.

6. Optional Viscosity Modifiers

The fibers described herein may further comprise one or more viscosity modifiers selected from the group of alkyl, alkenyl, aralkyl, or alkaryl carboxylates, or combinations thereof. The viscosity modifier is present in the melt extruded fiber in an amount sufficient to modify the melt viscosity of the aliphatic polyester. Typically, the viscosity modifier is present at less than 10 weight %, preferably less than 8 weight %, more preferably less than 7%, more preferably less than 6 weight %, more preferably less than 3 weight %, and most preferably less than 2% by weight based on the combined weight of the aliphatic polyester and viscosity modifier. Also the viscosity modifier is typically added at a concentration of at least 0.25% by weight of the aliphatic polyester, preferably at least 0.5% by weight of the aliphatic polyester, and most preferably at least 1% by weight of the aliphatic polyester.

In another aspect, films, fabrics and webs constructed from the fibers are described herein. The invention also provides useful articles made from fabrics and webs of fibers including medical drapes, sterilization wraps, medical gowns, aprons, filter media, industrial wipes and personal care and home care products such as diapers, facial tissue, facial wipes, wet wipes, dry wipes, disposable absorbent articles and garments such as disposable and reusable garments including infant diapers or training pants, adult incontinence products, feminine hygiene products such as sanitary napkins, panty liners and the like.

B. Dimensionally Stable Nonwoven Fibrous Web Components

Various components of exemplary dimensionally stable nonwoven fibrous webs according to the present disclosure will now be described. The dimensionally stable nonwoven fibrous webs include a plurality of fibers comprising one or more thermoplastic polyesters selected from aliphatic polyesters and aromatic polyesters; and an antishrink additive, wherein the web has at least one dimension which decreases by no greater than 12% in the plane of the web when the web is heated to a temperature above a glass transition temperature of the fibers.

1. Thermoplastic Polyesters

The fibrous webs of the present disclosure include at least one thermoplastic polyester. In some exemplary embodiments an aromatic polyester is used as a major component in the fiber-forming mixture. In certain exemplary embodiments, the aromatic polyester is selected poly(ethylene) terephthalate (PET), poly(ethylene) terephthalate glycol (PETG), poly(butylene) terephthalate (PBT), poly(trimethyl) terephthalate (PTT), their copolymers, and combinations thereof.

In other exemplary embodiments, an aliphatic polyester is used as a major component in the fiber-forming mixture. Aliphatic polyesters useful in practicing embodiments of the present invention include homo- and copolymers of poly (hydroxyalkanoates), and homo- and copolymers of those aliphatic polyesters derived from the reaction product of one or more polyols with one or more polycarboxylic acids that is typically formed from the reaction product of one or more alkanediols with one or more alkanedicarboxylic acids (or acyl derivatives). Polyesters may further be derived from multifunctional polyols, e.g. glycerin, sorbitol, pentaerythritol, and combinations thereof, to form branched, star, and graft homo- and copolymers. Miscible and immiscible blends of aliphatic polyesters with one or more additional semicrystalline or amorphous polymers may also be used.

Exemplary aliphatic polyesters are poly(lactic acid), poly (glycolic acid), poly(lactic-co-glycolic acid), polybutylene succinate, polyethylene adipate, polyhydroxybutyrate, polyhydroxyvalerate, blends, and copolymers thereof. One particularly useful class of aliphatic polyesters are poly(hydroxyalkanoates), derived by condensation or ring-opening polymerization of hydroxy acids, or derivatives thereof. Suitable poly(hydroxyalkanoates) may be represented by the formula:

$$H(O—R—C(O)—)_nOH,$$

where R is an alkylene moiety that may be linear or branched having 1 to 20 carbon atoms, preferably 1 to 12 carbon atoms optionally substituted by catenary (bonded to carbon atoms in a carbon chain) oxygen atoms; n is a number such that the ester is polymeric, and is preferably a number such that the molecular weight of the aliphatic polyester is at least 10,000, preferably at least 30,000, and most preferably at least 50,000 daltons. Although higher molecular weight polymers generally yield films with better mechanical properties, for both melt processed and solvent cast polymers excessive viscosity is typically undesirable. The molecular weight of the aliphatic polyester is typically no greater than 1,000,000, preferably no greater than 500,000, and most preferably no greater than 300,000 daltons. R may further comprise one or more catenary (i.e. in chain) ether oxygen atoms. Generally, the R group of the hydroxy acid is such that the pendant hydroxyl group is a primary or secondary hydroxyl group.

Useful poly(hydroxyalkanoates) include, for example, homo- and copolymers of poly(3-hydroxybutyrate), poly(4-hydroxybutyrate), poly(3-hydroxyvalerate), poly(lactic acid) (as known as polylactide), poly(3-hydroxypropanoate), poly(4-hydropentanoate), poly(3-hydroxypentanoate), poly(3-hydroxyhexanoate), poly(3-hydroxyheptanoate), poly(3-hydroxyoctanoate), polydioxanone, polycaprolactone, and polyglycolic acid (i.e., polyglycolide). Copolymers of two or more of the above hydroxy acids may also be used, for example, poly(3-hydroxybutyrate-co-3-hydroxyvalerate), poly(lactate-co-3-hydroxypropanoate), poly(glycolide-co-p-dioxanone), and poly(lactic acid-co-glycolic acid). Blends of two or more of the poly(hydroxyalkanoates) may also be used, as well as blends with one or more polymers and/or copolymers.

Aliphatic polyesters useful in the inventive fibers may include homopolymers, random copolymers, block copolymers, star-branched random copolymers, star-branched block copolymers, dendritic copolymers, hyperbranched copolymers, graft copolymers, and combinations thereof.

Another useful class of aliphatic polyesters includes those aliphatic polyesters derived from the reaction product of one or more alkanediols with one or more alkanedicarboxylic acids (or acyl derivatives). Such polyesters have the general formula:

$$HO(C(=O)R''C(=O))_n\text{—}[OR'O\text{—}C(=O)\text{—}R''\text{—}C(=O)\text{—}O]_m\bullet(R'O)_nH,$$

where R' and R" each represent an alkylene moiety that may be linear or branched having from 1 to 20 carbon atoms, preferably 1 to 12 carbon atoms, and m is a number such that the ester is polymeric, and is preferably a number such that the molecular weight of the aliphatic polyester is at least 10,000, preferably at least 30,000, and most preferably at least 50,000 daltons, but no greater than 1,000,000, preferably no greater than 500,000 and most preferably no greater than 300,000 daltons. Each n is independently 0 or 1. R' and R" may further comprise one or more caternary (i.e. in chain) ether oxygen atoms.

Examples of aliphatic polyesters include those homo- and copolymers derived from (a) one or more of the following diacids (or derivative thereof): succinic acid; adipic acid; 1,12 dicarboxydodecane; fumaric acid; glutartic acid; diglycolic acid; and maleic acid; and (b) one of more of the following diols: ethylene glycol; polyethylene glycol; 1,2-propane diol; 1,3-propanediol; 1,2-propanediol; 1,2-butanediol; 1,3-butanediol; 1,4-butanediol; 2,3-butanediol; 1,6-hexanediol; 1,2 alkane diols having 5 to 12 carbon atoms; diethylene glycol; polyethylene glycols having a molecular weight of 300 to 10,000 daltons, preferably 400 to 8,000 daltons; propylene glycols having a molecular weight of 300 to 4000 daltons; block or random copolymers derived from ethylene oxide, propylene oxide, or butylene oxide; dipropylene glycol; and polypropylene glycol, and (c) optionally a small amount, i.e., 0.5-7.0-mole % of a polyol with a functionality greater than two such as glycerol, neopentyl glycol, and pentaerythritol.

Such polymers may include polybutylenesuccinate homopolymer, polybutylene adipate homopolymer, polybutyleneadipate-succinate copolymer, polyethylenesuccinate-adipate copolymer, polyethylene glycol succinate homopolymer and polyethylene adipate homopolymer.

Commercially available aliphatic polyesters include poly(lactide), poly(glycolide), poly(lactide-co-glycolide), poly(L-lactide-co-trimethylene carbonate), poly(dioxanone), poly(butylene succinate), and poly(butylene adipate).

Preferred aliphatic polyesters include those derived from semicrystalline polylactic acid. Poly(lactic acid) or polylactide has lactic acid as its principle degradation product, which is commonly found in nature, is non-toxic and is widely used in the food, pharmaceutical and medical industries. The polymer may be prepared by ring-opening polymerization of the lactic acid dimer, lactide. Lactic acid is optically active and the dimer appears in four different forms: L,L-lactide, D,D-lactide, D,L-lactide (meso lactide) and a racemic mixture of L,L- and D,D-. By polymerizing these lactides as pure compounds or as blends, poly(lactide) polymers may be obtained having different stereochemistries and different physical properties, including crystallinity. The L,L- or D,D-lactide yields semicrystalline poly(lactide), while the poly(lactide) derived from the D,L-lactide is amorphous.

The polylactide preferably has a high enantiomeric ratio to maximize the intrinsic crystallinity of the polymer. The degree of crystallinity of a poly(lactic acid) is based on the regularity of the polymer backbone and the ability to crystallize with other polymer chains. If relatively small amounts of one enantiomer (such as D-) is copolymerized with the opposite enantiomer (such as L-) the polymer chain becomes irregularly shaped, and becomes less crystalline. For these reasons, when crystallinity is favored, it is desirable to have a poly(lactic acid) that is at least 85% of one isomer, more preferably at least 90% of one isomer, or even more preferably at least 95% of one isomer in order to maximize the crystallinity.

An approximately equimolar blend of D-polylactide and L-polylactide is also useful. This blend forms a unique crystal structure having a higher melting point (~210° C.) than does either the D-poly(lactide) and L-(polylactide) alone (~160° C.), and has improved thermal stability, see. See H. Tsuji et al., Polymer, 40 (1999) 6699-6708.

Copolymers, including block and random copolymers, of poly(lactic acid) with other aliphatic polyesters may also be used. Useful co-monomers include glycolide, beta-propiolactone, tetramethylglycolide, beta-butyrolactone, gamma-butyrolactone, pivalolactone, 2-hydroxybutyric acid, alpha-hydroxyisobutyric acid, alpha-hydroxyvaleric acid, alpha-hydroxyisovaleric acid, alpha-hydroxycaproic acid, alpha-hydroxyethylbutyric acid, alpha-hydroxyisocaproic acid, alpha-hydroxy-beta-methylvaleric acid, alpha-hydroxyoctanoic acid, alpha-hydroxydecanoic acid, alpha-hydroxymyristic acid, and alpha-hydroxystearic acid.

Blends of poly(lactic acid) and one or more other aliphatic polyesters, or one or more other polymers may also be used. Examples of useful blends include poly(lactic acid) and poly(vinyl alcohol), polyethylene glycol/polysuccinate, polyethylene oxide, polycaprolactone and polyglycolide.

Poly(lactide)s may be prepared as described in U.S. Pat. No. 6,111,060 (Gruber, et al.), U.S. Pat. No. 5,997,568 (Liu), U.S. Pat. No. 4,744,365 (Kaplan et al.), U.S. Pat. No. 5,475,063 (Kaplan et al.), U.S. Pat. No. 6,143,863 (Gruber et al.), U.S. Pat. No. 6,093,792 (Gross et al.), U.S. Pat. No. 6,075,118 (Wang et al.), and U.S. Pat. No. 5,952,433 (Wang et al.), WO 98/24951 (Tsai et al.), WO 00/12606 (Tsai et al.), WO 84/04311 (Lin), U.S. Pat. No. 6,117,928 (Hiltunen et al.), U.S. Pat. No. 5,883,199 (McCarthy et al.), WO 99/50345 (Kolstad et al.), WO 99/06456 (Wang et al.), WO 94/07949 (Gruber et al.), WO 96/22330 (Randall et al.), and WO 98/50611 (Ryan et al.), the disclosure of each patent incorporated herein by reference. Reference may also be made to J. W. Leenslag, et al., J. Appl. Polymer Science, vol. 29 (1984), pp 2829-2842, and H. R. Kricheldorf, Chemosphere, vol. 43, (2001) 49-54.

The molecular weight of the polymer should be chosen so that the polymer may be processed as a melt. For polylactide, for example, the molecular weight may be from about 10,000 to 1,000,000 daltons, and is preferably from about 30,000 to 300,000 daltons. By "melt-processible", it is meant that the aliphatic polyesters are fluid or can be pumped or extruded at the temperatures used to process the articles (e.g. make the fibers in BMF), and do not degrade or gel at those temperatures to the extent that the physical properties are so poor as to be unusable for the intended application. Thus, many of the materials can be made into nonwovens using melt processes such as spunbond, blown microfiber, and the like. Certain embodiments also may be injection molded. The aliphatic polyester may be blended with other polymers but typically comprises at least 50 weight percent, preferably at least 60 weight percent, and most preferably at least 65 weight percent of the fibers.

2. Antishrinkage Additive

The term "antishrinkage" additive refers to a thermoplastic polymeric additive which, when added to the aliphatic polyester in a concentration less than 10% by weight of the aliphatic polyester and formed into a nonwoven web, results in a web having at least one dimension which decreases by no greater than 10% in the plane of the web when the web is heated to a temperature above a glass transition temperature of the fibers, but below the melting point of the fibers in an unrestrained (free to move) state. Preferred antishrinkage additives form a dispersed phase in the aliphatic polyester when the mixture is cooled to 23-25° C. Preferred antishrinkage additives are also semicrystalline thermoplastic polymers as determined by differential scanning calorimetry.

The inventors have found that semicrystalline polymers tend to be effective at reducing shrinkage in the polyester nonwoven products (spunbond and blow microfiber webs) at relatively low blend levels, e.g. less than 10% by weight, preferably less than 6% by weight, and most preferably at less than 3% by weight.

Potentially useful semicrystalline polymers include polyethylene, linear low density polyethylene, polypropylene, polyoxymethylene, poly(vinylidine fluoride), poly(methyl pentene), poly(ethylene-chlorotrifluoroethylene), poly(vinyl fluoride), poly(ethylene oxide), poly(ethylene terephthalate), poly(butylene terephthalate), semicrystalline aliphatic polyesters including polycaprolactone, aliphatic polyamides such as nylon 6 and nylon 66, and thermotropic liquid crystal polymers. Particularly preferred semicreystalline polymers include polypropylene, nylon 6, nylon 66, polycaprolactone, polyethylene oxides. The antishinkage additives have been shown to dramatically reduce the shrinkage of PLA nonwovens.

The molecular weight of these additives may effect the ability to promote shrinkage reduction. Preferably the MW is greater than about 10,000 daltons, preferably greater than 20,000 daltons, more preferably greater than 40,000 daltons and most preferably greater than 50,000 daltons. Derivatives of the thermoplastic antishrinkage polymers also may be suitable. Preferred derivatives will likely retain some degree of crystallinity. For example, polymers with reactive end groups such as PCL and PEO can be reacted to form, for example, polyesters or polyurethanes, thus increasing the average molecular weight. For example, a 50,000 MW PEO can be reacted at an isocyanate/alcohol ratio of 1:2 with 4,4' diphenylmethane diisocyanate to form a nominally 100,000 MW PEO containing polyurethane with OH functional end groups.

While not intending to be bound by theory, it is believed that the antishrinkage additives form a dispersion that is randomly distributed through the core of the filament. It is recognized that the dispersion size may vary throughout the filament. For example, the size of the dispersed phase particles may be smaller at the exterior of the fiber where shear rates are higher during extrusion and lower near the core. The antishrinkage additive may prevent or reduce shrinkage by forming a dispersion in the polyester continuous phase. The dispersed antishrinkage additive may take on a variety of discrete shapes such as spheres, ellipsoids, rods, cylinders, and many other shapes.

A highly preferred antishrinkage additive is polypropylene. Polypropylene (homo)polymers and copolymers useful in practicing embodiments of the present disclosure may be selected from polypropylene homopolymers, polypropylene copolymers, and blends thereof (collectively polypropylene (co)polymers). The homopolymers may be atactic polypropylene, isotactic polypropylene, syndiotactic polypropylene and blends thereof. The copolymer can be a random copolymer, a statistical copolymer, a block copolymer, and blends thereof. In particular, the inventive polymer blends described herein include impact (co)polymers, elastomers and plastomers, any of which may be physical blends or in situ blends with the polypropylene.

The method of making the polypropylene (co)polymer is not critical, as it can be made by slurry, solution, gas phase or other suitable processes, and by using catalyst systems appropriate for the polymerization of polyolefins, such as Ziegler-Natta-type catalysts, metallocene-type catalysts, other appropriate catalyst systems or combinations thereof. In a preferred embodiment the propylene (co)polymers are made by the catalysts, activators and processes described in U.S. Pat. Nos. 6,342,566; 6,384,142; WO 03/040201; WO 97/19991 and U.S. Pat. No. 5,741,563. Likewise, (co)polymers may be prepared by the process described in U.S. Pat. Nos. 6,342,566 and 6,384,142. Such catalysts are well known in the art, and are described in, for example, ZIEGLER CATALYSTS (Gerhard Fink, Rolf Mulhaupt and Hans H. Brintzinger, eds., Springer-Verlag 1995); Resconi et al., Selectivity in Propene Polymerization with Metallocene Catalysts, 100 CHEM. REV. 1253-1345 (2000); and I, II METALLOCENE-BASED POLYOLEFINS (Wiley & Sons 2000).

Propylene (co)polymers that are useful in practicing some embodiments of the presently disclosed invention include those sold under the tradenames ACHIEVE and ESCORENE by Exxon-Mobil Chemical Company (Houston, Tex.), and various propylene (co)polymers sold by Total Petrochemicals (Hoston, Tex.).

Presently preferred propylene homopolymers and copolymers useful in this invention typically have: 1) a weight average molecular weight (Mw) of at least 30,000 Da, preferably at least 50,000 Da, more preferably at least 90,000 Da, as measured by gel permeation chromatography (GPC), and/or no more than 2,000,000 Da, preferably no more than 1,000,000 Da, more preferably no more than 500,000 Da, as measured by gel permeation chromatography (GPC); and/or 2) a polydispersity (defined as Mw/Mn, wherein Mn is the number average molecular weight determined by GPC) of 1, preferably 1.6, and more preferably 1.8, and/or no more than 40, preferably no more than 20, more preferably no more than 10, and even more preferably no more than 3; and/or 3) a melting temperature Tm (second melt) of at least 30° C., preferably at least 50° C., and more preferably at least 60° C. as measured by using differential scanning calorimetry (DSC), and/or no more than 200° C., preferably no more than 185° C., more preferably no more than 175° C., and even more preferably no more than 170° C. as measured by using differential scanning calorimetry (DSC); and/or 4) a crystallinity of at least 5%, preferably at least 10%, more preferably at least 20% as measured using DSC, and/or no more than 80%, preferably no more than 70%, more preferably no more than 60% as measured using DSC; and/or 5) a glass transition temperature (Tg) of at least −40° C., preferably at least −10° C., more preferably at least −10° C., as measured by dynamic mechanical thermal analysis (DMTA), and/or no more than 20° C., preferably no more than 10° C., more preferably no more than 50° C., as measured by dynamic mechanical thermal analysis (DMTA); and/or 6) a heat of fusion (Hf) of 180 J/g or less, preferably 150 J/g or less, more preferably 120 J/g or less as measured by DSC and/or at least 20 J/g, more preferably at least 40 J/g as measured by DSC; and/or 7) a crystallization temperature (Tc) of at least 15° C., preferably at least 20° C., more preferably at least 25° C., even more preferably at least 60° C. and/or, no more than 120° C., preferably no more than 115° C., more preferably no more than 110° C., even more preferably no more than 145° C.

Exemplary webs of the present disclosure may include propylene (co)polymers (including both poly(propylene) homopolymers and copolymers) in an amount of at least 1% by weight of the web, more preferably at least about 2% by weight of the web, most preferably at least 3% by weight of the web. Other exemplary webs may include propylene (co)polymers (including both poly(propylene) homopolymers and copolymers) in an amount no more than 10% by weight of the web, more preferably in an amount no more than 8% by weight of the web, most preferably in an amount no more than 6% by weight of the web. In certain presently preferred embodiments, the webs comprise polypropylene from about 1% to about 6% by weight of the web, more preferably from about 3% to no more than 5% by weight of the web.

3. Optional Additives

Fibers also may be formed from blends of materials, including materials into which certain additives have been blended, such as pigments or dyes. In addition to the fiber-forming materials mentioned above, various additives may be added to the fiber melt and extruded to incorporate the additive into the fiber. Typically, the amount of additives other than the PP and viscosity modifier is no greater than about 25 wt % of the polyester, desirably, no greater than about 10% by weight of the polyester, more desirably no greater than 5.0%, by weight of the polyester. Suitable additives include, but are not limited to, particulates, fillers, stabilizers, plasticizers, tackifiers, flow control agents, cure rate retarders, adhesion promoters (for example, silanes and titanates), adjuvants, impact modifiers, expandable microspheres, thermally conductive particles, electrically conductive particles, silica, glass, clay, talc, pigments, colorants, glass beads or bubbles, antioxidants, optical brighteners, antimicrobial agents, surfactants, wetting agents, fire retardants, and repellents such as hydrocarbon waxes, silicones, and fluoro chemicals.

One or more of the above-described additives may be used to reduce the weight and/or cost of the resulting fiber and layer, adjust viscosity, or modify the thermal properties of the fiber or confer a range of physical properties derived from the physical property activity of the additive including electrical, optical, density-related, liquid barrier or adhesive tack related properties.

Fillers (i.e. insoluble organic or inorganic materials generally added to augment weight, size or to fill space in the resin for example to decrease cost or impart other properties such as density, color, impart texture, effect degradation rate and the like) can detrimentally effect fiber properties. Fillers can be particulate nonthermoplastic or thermoplastic materials. Fillers also may be non-aliphatic polyesters polymers which often are chosen due to low cost such as starch, lignin, and cellulose based polymers, natural rubber, and the like. These filler polymers tend to have little or no cyrstallinity. Fillers, plasticizers, and other additives when used at levels above 3% by weight and certainly above 5% by weight of the aliphatic polyester resin can have a significant negative effect on physical properties such as tensile strength of the nonwoven web. Above 10% by weight of the aliphatic polyester these additives can have a dramatic negative effect on physical properties. Therefore, total additives other than the polypropylene preferably are present at no more than 10% by weight, preferably no more than 5% by weight and most preferably no more than 3% by weight based on the weight of the polyester in the final nonwoven article. The compounds may be present at much higher concentrations in masterbatch concentrates used to make the nonwoven. For example, nonwoven spunbond webs of the present invention having a basis weight of 45 g/meter$^2$ preferably have a tensile strength of at least 30 N/mm width, preferably at least 40 N/mm width. More preferably at least 50 N/mm width and most preferably at least 60 N/mm width when tested on mechanical test equipment as specified in the Examples.

i) Plasticizers

In some exemplary embodiments, a plasticizer for the thermoplastic polyester may be used in forming the fibers. In some exemplary embodiments, the plasticizer for the thermoplastic polyester is selected from poly(ethylene glycol), oligomeric polyesters, fatty acid monoesters and di-esters, citrate esters, or combinations thereof. Suitable plasticizers that may be used with the aliphatic polyesters include, for example, glycols such glycerin; propylene glycol, polyethoxylated phenols, mono or polysubstituted polyethylene glycols, higher alkyl substituted N-alkyl pyrrolidones, sulfonamides, triglycerides, citrate esters, esters of tartaric acid, benzoate esters, polyethylene glycols and ethylene oxide propylene oxide random and block copolymers having a molecular weight no greater than 10,000 Daltons (Da), preferably no greater than about 5,000 Da, more preferably no greater than about 2,500 Da; and combinations thereof.

ii) Diluent

In some exemplary embodiments, a diluent may be added to the mixture used to form the fibers. In certain exemplary embodiments, the diluent may be selected from a fatty acid monoester (FAME), a PLA oligomer, or combinations thereof. Diluent as used herein generally refers to a material that inhibits, delays, or otherwise affects crystallinity as compared to the crystallinity that would occur in the absence of the diluent. Diluents may also function as plasticizers.

iii) Antimicrobials

An antimicrobial component may be added to impart antimicrobial activity to the fibers. The antimicrobial component is the component that provides at least part of the antimicrobial activity, i.e., it has at least some antimicrobial activity for at least one microorganism. It is preferably present in a large enough quantity to be released from the fibers and kill bacteria. It may also be biodegradable and/or made or derived from renewable resources such as plants or plant products. Biodegradable antimicrobial components can include at least one functional linkage such as an ester or amide linkage that can be hydrolytically or enzymatically degraded.

In some exemplary embodiments, a suitable antimicrobial component may be selected from a fatty acid monoester, a fatty acid di-ester, an organic acid, a silver compound, a quaternary ammonium compound, a cationic (co)polymer, an iodine compound, or combinations thereof. Other examples of antimicrobial components suitable for use in the present invention include those described in Applicants' co-pending application, U.S. Patent Application Publication No. 2008/0142023,-A1, and incorporated by reference herein in its entirety.

Certain antimicrobial components are uncharged and have an alkyl or alkenyl hydrocarbon chain containing at least 7 carbon atoms. For melt processing, preferred antimicrobial components have low volatility and do not decompose under process conditions. The preferred antimicrobial components contain no greater than 2 wt. % water, and more preferably no greater than 0.10 wt. % (determined by Karl Fischer analysis). Moisture content is kept low in order to prevent hydrolysis of the aliphatic polyester during extrusion.

When used, the antimicrobial component content (as it is ready to use) is typically at least 1 wt. %, 2 wt. %, 5 wt. %, 10 wt. % and sometimes greater than 15 wt. %. In certain embodiments, for example applications in which a low strength is desired, the antimicrobial component comprises greater than 20 wt. %, greater than 25 wt. %, or even greater than 30 wt. % of the fibers.

Certain antimicrobial components are amphiphiles and may be surface active. For example, certain antimicrobial alkyl monoglycerides are surface active. For certain embodiments of the invention that include antimicrobial components, the antimicrobial component is considered distinct from a viscosity modifier component.

iv) Particulate Phase

The fibers may further comprise organic and inorganic fillers present as either an internal particulate phase within the fibers, or as an external particulate phase on or near the surface of the fibers. For implantable applications biodegradable, resorbable, or bioerodible inorganic fillers may be particularly appealing. These materials may help to control the degradation rate of the polymer fibers. For example, many calcium salts and phosphate salts may be suitable. Exemplary biocompatible resorbable fillers include calcium carbonate, calcium sulfate, calcium phosphate, calcium sodium phosphates, calcium potassium phosphates, tetra-calcium phosphate, alpha-tri-calcium phosphate, beta-tri-calcium phosphate, calcium phosphate apatite, octa-calcium phosphate, di-calcium phosphate, calcium carbonate, calcium oxide, calcium hydroxide, calcium sulfate di-hydrate, calcium sulfate hemihydrate, calcium fluoride, calcium citrate, magnesium oxide, and magnesium hydroxide. A particularly suitable filler is tri-basic calcium phosphate (hydroxy apatite).

As described previously, these fillers and compounds can detrimentally effect physical properties of the web. Therefore, total additives other than the antishrink additive preferably are present at no more than 10% by weight, preferably no more than 5% by weight and most preferably no more than 3% by weight.

v) Surfactants

In certain exemplary embodiments, it may be desirable to add a surfactant to the mixture used to form the fibers. In particular exemplary embodiments, the surfactant may be selected from a nonionic surfactant, an anionic surfactant, a cationic surfactant, a zwitterionic surfactant, or combinations thereof. In additional exemplary embodiments, the surfactant may be selected from a fluoro-organic surfactant, a silicone-functional surfactant, an organic wax, or a salt of anionic surfactants such as dioctylsulfosuccinate.

In one presently preferred embodiment, the fibers may comprise anionic surfactants that impart durable hydrophilicity. Examples of anionic surfactants suitable for use in the present invention include those described in Applicants' co-pending application, U.S. Patent Application Publication No. US2008/0200890 and U.S. Ser. No. 61/061,088, filed Jun. 12, 2008, and incorporated by reference herein in its entirety.

The fibers may also comprise anionic surfactants that impart durable hydrophilicity. Surfactants may be selected from the group of alkyl, alkaryl, alkenyl or aralkyl sulfate; alkyl, alkaryl, alkenyl or aralkyl sulfonate; alkyl, alkaryl, alkenyl or aralkyl carboxylate; or alkyl, alkaryl, alkenyl or aralkyl phosphate surfactants. The compositions may optionally comprise a surfactant carrier which may aid processing and/or enhance the hydrophilic properties. The blend of the surfactant(s) and optionally a surfactant carrier alkenyl, aralkyl, or alkaryl carboxylates, or combinations thereof. The viscosity modifier is present in the melt extruded fiber in an amount sufficient to impart durable hydrophilicity to the fiber at its surface.

Preferably the surfactant is soluble in the carrier at temperatures at the concentrations used. Solubility can be evaluated, for example, as the surfactant and carrier form a visually transparent solution in a 1 cm path length glass vial when heated to extrusion temperature (e.g. 150-190° C.). Preferably the surfactant is soluble in the carrier at 150° C. More preferably the surfactant is soluble in the carrier at less than 100° C. so that it can be more easily incorporated into the polymer melt. More preferably the surfactant is soluble in the carrier at 25° C. so that no heating is necessary when pumping the solution into the polymer melt. Preferably the surfactant is soluble in the carrier at greater than 10% by weight, more preferably greater than 20% by weight, and most preferably greater than 30% by weight in order to allow addition of the surfactant without too much carrier present, which may plasticize the thermoplastic. Typically the surfactants are present at present in a total amount of at least 0.25 wt-%, preferably at least 0.50 wt-%, more preferably at least 0.75 wt-%, based on the total weight of the composition. In certain embodiments, in which a very hydrophilic web is desired, or a web that can withstand multiple assaults with aqueous fluid, the surfactant component comprises greater than 2 wt. %, greater than 3 wt. %, or even greater than 5 wt. % of the aliphatic polyester polymer composition. In certain embodiments, the surfactants typically are present at 0.25 wt-% to 8 wt-% of the aliphatic polyester polymer composition. Typically, the viscosity modifier is present at less than 10 weight %, preferably less than 8 weight %, more preferably less than 7%, more preferably less than 6 weight %, more preferably less than 3 weight %, and most preferably less than 2% by weight based on the combined weight of the aliphatic polyester.

The surfactant and optional carrier should be relatively free of moisture in order to prevent hydrolysis of the aliphatic polyester. Preferably the surfactant and optional carrier, either alone or in combination, comprise less than 5% water, more preferably less than 2% water, even more preferably less than 1% water, and most preferably less than 0.5% water by weight as determined by a Karl-Fisher titration.

Certain classes of hydrocarbon, silicone, and fluorochemical surfactants have each been described as useful for imparting hydrophilicity to polyolefins. These surfactants typically are contacted with the thermoplastic resin in one of two ways: (1) by topical application, e.g., spraying or padding or foaming, of the surfactants from aqueous solution to the extruded nonwoven web or fiber followed by drying, or (2) by incorporation of the surfactant into the polyolefin melt prior to extrusion of the web. The latter is much preferable but is difficult to find a surfactant that will spontaneously bloom to the surface of the fiber or film in sufficient amount to render the article hydrophilic. As previously described, webs made hydrophilic by topical application of a surfactant suffer many drawbacks. Some are reported to also have diminished hydrophilicity after a single contact with aqueous media. Additional disadvantages to topical application of a surfactant to impart hydrophilicity may include skin irritation from the surfactant itself, non-uniform surface and bulk hydrophilicity, and the additive cost resulting from the necessity of an added processing step in the surfactant application. Incorporating one or more surfactants into to the thermoplastic polymer as a melt additive alleviates the problems associated with topical application and in addition may provide a softer "hand" to the fabric or nonwoven web into which it is incorporated. The challenge as previously stated, is finding a surfactant that will reliably bloom to the surface of the article in sufficient amount to impart hydrophilicity and then to remain properly oriented at the surface to ensure durable hydrophilicity.

The fibers described herein remain hydrophilic and water absorbent after repeated insult with water, e.g. saturating with water, wringing out and allowing to dry. Preferred compositions of this invention include a relatively homogenous composition comprising at least one aliphatic polyester resin (preferably polylactic acid), at least one alkylsulfate, alkylene sulfate, or aralkyl or alkaryl sulfate, carboxylate, or phosphate surfactant, typically in an amount of at 0.25 wt % to 8 wt %, and optionally a nonvolatile carrier in a concentration of 1 wt % to 8 wt %, based on the weight of the aliphatic polyester as described in more detail below.

Preferred porous fabric constructions of the present invention produced as nonwovens have apparent surface energies greater than 60 dynes/cm, and preferably greater than 70 dynes/cm when tested by the Apparent Surface Energy Test disclosed in the Examples. Preferred porous fabric materials of this invention wet with water and thus have an apparent surface energy of greater than 72 dynes/cm (surface tension of pure water). The most preferred materials of this invention instantly absorb water and remain water absorbent after aging for 10 days at 5° C., 23° C. and 45° C. Preferably, the nonwoven fabrics are "instantaneously absorbent" such that when a 200 ul drop of water is gently placed on an expanse of nonwoven on a horizontal surface it is completely absorbed in less than 10 seconds, preferably less than 5 seconds and most preferably less than 3 seconds.

The surfactant carrier and/or surfactant component in many embodiments can plasticize the polyester component allowing for melt processing and solvent casting of higher molecular weight polymers. Generally, weight average molecular weight (Mw) of the polymers is above the entanglement molecular weight, as determined by a log-log plot of viscosity versus number average molecular weight (Mn). Above the entanglement molecular weight, the slope of the plot is about 3.4, whereas the slope of lower molecular weight polymers is 1.

As used herein the term "surfactant" means an amphiphile (a molecule possessing both polar and nonpolar regions which are covalently bound) capable of reducing the surface tension of water and/or the interfacial tension between water and an immiscible liquid. The term is meant to include soaps, detergents, emulsifiers, surface active agents, and the like.

In certain preferred embodiments, the surfactants useful in the compositions of the present invention are anionic surfactants selected from the group consisting of alkyl, alkenyl, alkaryl and arakyl sulfonates, sulfates, phosphonates, phosphates and mixtures thereof. Included in these classes are alkylalkoxylated carboxylates, alkyl alkoxylated sulfates, alkylalkoxylated sulfonates, and alkyl alkoxylated phosphates, and mixtures thereof. The preferred alkoxylate is made using ethylene oxide and/or propylene oxide with 0-100 moles of ethylene and propylene oxide per mole of hydrophobe. In certain more preferred embodiments, the surfactants useful in the compositions of the present invention are selected from the group consisting of sulfonates, sulfates, phosphates, carboxylates and mixtures thereof. In one aspect, the surfactant is selected from (C8-C22) alkyl sulfate salts (e.g., sodium salt); di(C8-C13 alkyl)sulfosuccinate salts; C8-C22 alkyl sarconsinate; C8-C22 alkyl lactylates; and combinations thereof. Combinations of various surfactants can also be used. The anionic surfactants useful in this invention are described in more detail below and include surfactants with the following structure:

$$(R{-}(O)_xSO_3^-)_nM^{n+} \text{ and } (R{-}O)_2P(O)O^-)_n \text{ or } R{-}OP(O)(O^-)_2aM^{n+}$$

Where: R— is alkyl or alkylene of C8-C30, which is branched or straight chain, or C12-C30 aralkyl, and may be optionally substituted with 0-100 alkylene oxide groups such as ethylene oxide, propylene oxide groups, oligameric lactic and/or glycolic acid or a combination thereof; X=0 or 1

M=is H, an alkali metal salts or an alkaline earth metal salt, preferably $Li^+$, $Na^+$, $K^+$, or amine salts including tertiary and quaternary amines such as protonated triethanolamine, tetramethylammonium and the like. Preferably M may be Ca or Mg however, these are less preferred.

n=1 or 2 a=1 when n=2 and a=2 when n=1.

Examples include C8-C18 alkane sulfonates; C8-C18 secondary alkane sulfonates; alkylbenzene sulfonates such as dodecylbenzene sulfonate; C8-C18 alkyl sulfates; alkylether sulfates such as sodium trideceth-4 sulfate, sodium laureth 4 sulfate, sodium laureth 8 sulfate (such as those available from Stepan Company, Northfield Ill.), docusate sodium also known as dioctylsulfosuccinate, sodium salt; lauroyl lacylate and stearoyl lactylate (such as those available from RITA Corporation, Crystal Lake, Ill. under the PATIONIC tradename), and the like. Additional examples include stearyl phosphate (available as Sippostat 0018 from Specialty Industrial Products, Inc., Spartanburg, S.C.); Ceteth-10 PPG-5 phosphate (Crodaphos SG, available from Croda USA, Edison N.J.); laureth-4 phosphate; and dilaureth-4 phosphate.

Exemplary anionic surfactants include, but are not limited to, sarcosinates, glutamates, alkyl sulfates, sodium or potassium alkyleth sulfates, ammonium alkyleth sulfates, ammonium laureth-n-sulfates, laureth-n-sulfates, isethionates, glycerylether sulfonates, sulfosuccinates, alkylglyceryl ether sulfonates, alkyl phosphates, aralkyl phosphates, alkylphosphonates, and aralkylphosphonates. These anionic surfactants may have a metal or organic ammonium counterion. Certain useful anionic surfactants are selected from the group consisting of: sulfonates and sulfates such as alkyl sulfates, alkylether sulfates, alkyl sulfonates, alkylether sulfonates, alkylbenzene sulfonates, alkylbenzene ether sulfates, alkylsulfoacetates, secondary alkane sulfonates, secondary alkylsulfates, and the like. Many of these can be represented by the formulas:

R26-(OCH2CH2)*n*6(OCH(CH3)CH2)*p*2-(Ph)*a*-(OCH2CH2)*m*3-(O)*b*-SO3-M+ and

R26-CH[SO3-M+]-R27 wherein: a and b=0 or 1; n6, p2, and m3=0-100 (preferably 0-20); R26 is defined as below provided at least one R26 or R27 is at least C8; R27 is a (C1-C12)alkyl group (saturated straight, branched, or cyclic group) that may be optionally substituted by N, O, or S atoms or hydroxyl, carboxyl, amide, or amine groups; Ph=phenyl; and M is a cationic counterion such as H, Na, K, Li, ammonium, or a protonated tertiary amine such as triethanolamine or a quaternary ammonium group.

In the formula above, the ethylene oxide groups (i.e., the "n6" and "m3" groups) and propylene oxide groups (i.e., the "p2" groups) can occur in reverse order as well as in a random, sequential, or block arrangement. R26 may be an alkylamide group such as R28-C(O)N(CH3)CH2CH2- as well as ester groups such as —OC(O)—CH2- wherein R28 is a (C8-C22)alkyl group (branched, straight, or cyclic group). Examples include, but are not limited to: alkyl ether sulfonates, including lauryl ether sulfates (such as POLYSTEP B12 (n=3-4, M=sodium) and B22 (n=12, M=ammonium) available from Stepan Company, Northfield, Ill.) and sodium methyl taurate (available under the trade designation NIKKOL CMT30, Nikko Chemicals Co., Tokyo, Japan); secondary alkane sulfonates, including sodium (C14-C17) secondary alkane sulfonates (alpha-olefin sulfonates) (such as Hostapur SAS available from Clariant Corp., Charlotte, N.C.); methyl-2-sulfoalkyl esters such as sodium methyl-2-sulfo (C12-16)ester and disodium 2-sulfo(C12-C16) fatty acid (available from Stepan Company, Northfield, Ill. Under the trade designation ALPHASTEP PC-48); alkylsulfoacetates and alkylsulfosuccinates available as sodium laurylsulfoacetate (under the trade designation LANTHANOL LAL, Stepan Company, Northfield, Ill.) and disodiumlaurethsulfosuccinate (STEPANMILD SL3, Stepan Company, Northfield, Ill.); alkylsulfates such as ammoniumlauryl sulfate (available under the trade designation STEPANOL AM from Stepan Company, Northfield, Ill.); dialkylsulfosuccinates such as dioctylsodiumsulfosuccinate (available as Aerosol OT from Cytec Industries, Woodland Park, N.J.).

Suitable anionic surfactants also include phosphates such as alkyl phosphates, alkylether phosphates, aralkylphosphates, and aralkylether phosphates. Many may be represented by the formula:

[R26-(Ph)*a*-O(CH2CH2O)*n*6(CH2CH(CH3)O)*p*2*J*q2-P(O)[O-M+]*r*;

wherein: Ph, R26, a, n6, p2, and M are defined above; r is 0-2; and q2=1-3; with the proviso that when q2=1, r=2, and when q2=2, r=1, and when q2=3, r=0. As above, the ethylene oxide groups (i.e., the "n6" groups) and propylene oxide groups (i.e., the "p2" groups) can occur in reverse order as well as in a random, sequential, or block arrangement. Examples include a mixture of mono-, di- and tri-(alkyltetraglycolether)-o-phosphoric acid esters generally referred to as trilaureth-4-phosphate (available under the trade designation HOSTAPHAT 340KL from Clariant Corp.); as well as PPG-5 ceteth 10 phosphate (available under the trade designation CRODAPHOS SG from Croda Inc., Parsipanny, N.J.), and mixtures thereof.

In some embodiments, when used in the composition, the surfactants are present in a total amount of at least 0.25 wt.-%, at least 0.5 wt-%, at least 0.75 wt-%, at least 1.0 wt-%, or at least 2.0 wt-%, based on the total weight of the composition. In certain embodiments, in which a very hydrophilic web is desired, or a web that can withstand multiple assaults with aqueous fluid, the surfactant component comprises greater than 2 wt. %, greater than 3 wt. %, or even greater than 5 wt. % of the degradable aliphatic polyester polymer composition.

In other embodiments, the surfactants are present in a total amount of no greater than 20 wt. %, no greater than 15 wt. %, no greater than 10 wt. %, or no greater than 8 wt. %, based on the total weight of the ready to use composition.

Preferred surfactants have a melting point of less than 200° C., preferably less than 190° C., more preferably less than 180° C., and even more preferably less than 170° C.

For melt processing, preferred surfactant components have low volatility and do not decompose appreciably under process conditions. The preferred surfactants contain less than 10 wt. % water, preferably less than 5% water, and more preferably less than 2 wt. % and even more preferably less than 1% water (determined by Karl Fischer analysis). Moisture content is kept low in order to prevent hydrolysis of the aliphatic polyester or other hydrolytically sensitive compounds in the composition, which will help to give clarity to extruded films or fibers.

It can be particularly convenient to use a surfactant predissolved in a non-volatile carrier. Importantly, the carrier is typically thermally stable and can resist chemical breakdown at processing temperatures which may be as high as 150° C., 180° C., 200° C.° C., 250° C., or even as high as 250° C. In a preferred embodiment, the surfactant carrier is a liquid at 23° C.

Preferred carriers also may include low molecular weight esters of polyhydric alcohols such as triacetin, glyceryl caprylate/caprate, acetyltributylcitrate, and the like.

The solubilizing liquid carriers may alternatively be selected from non-volatile organic solvents. For purposes of the present invention, an organic solvent is considered to be nonvolatile if greater than 80% of the solvent remains in the composition throughout the mixing and melt processes. Because these liquids remain in the melt processable composition, they function as plasticizers, generally lowering the glass transition temperature of the composition.

Since the carrier is substantially nonvolatile it will in large part remain in the composition and may function as an organic plasticizer. As used herein a plasticizer is a compound which when added to the polymer composition results in a decrease in the glass transition temperature. Possible surfactant carriers include compounds containing one or more hydroxyl groups, and particularly glycols such glycerin; 1,2 pentanediol; 2,4 diethyl-1,5 pentanediol; 2-methyl-1,3-propanediol; as well as monofunctional compounds such 3-methoxy-methylbutanol ("MMB"). Additional examples of nonvolatile organic plasticizers include polyethers, including polyethoxylated phenols such as Pycal 94 (phenoxypolyethyleneglycol); alkyl, aryl, and aralkyl ether glycols (such as those sold under the Dowanol™ tradename by Dow Chemical Company, Midland Mich.) including but not limited to propyelene glycolmonobutyl ether (Dowanol PnB), tripropyleneglycol monobutyl ether (Dowanol TPnB), dipropyeleneglycol monobutyl ether (Dowanol DPnB), propylene glycol monophenyl ether (Dowanol PPH), and propylene glycol monomethyl ether (Dowanol PM); polyethoxylated alkyl phenols such as Triton X35 and Triton X102 (available from Dow Chemical Company, Midland Mich.); mono or polysubstituted polyethylene glycols such as PEG 400 diethylhexanoate (TegMer 809, available from CP Hall Company), PEG 400 monolaurate (CHP-30N available from CP Hall Company) and PEG 400 monooleate (CPH-41N available from CP Hall Company); amides including higher alkyl substituted N-alkyl pyrrolidones such as N-octylpyrrolidone; sulfonamides such as N-butylbenzene sulfonamide (available from CP Hall Company); triglycerides; citrate esters; esters of tartaric acid; benzoate esters (such as those available from Velsicol Chemical Corp., Rosemont Ill. under the Benzoflex tradename) including dipropylene glycoldibenzoate (Benzoflex 50) and diethylene glycol dibenzoate; benzoic acid diester of 2,2,4 trimethyl 1,3 pentane diol (Benzoflex 354), ethylene glycol dibenzoate, tetraetheylene glycoldibenzoate, and the like; polyethylene glycols and ethylene oxide propylene oxide random and block copolymers having a molecular weight less than 10,000 daltons, preferably less than about 5000 daltons, more preferably less than about 2500 daltons; and combinations of the foregoing. As used herein the term polyethylene glycols refer to glycols having 26 alcohol groups that have been reacted with ethylene oxide or a 2 haloethanol.

Preferred polyethylene glycols are formed from ethylene glycol, propylene glycol, glycerin, trimethylolpropane, pentaerithritol, sucrose and the like. Most preferred polyethylene glycols are formed from ethylene glycol, propylene glycol, glycerin, and trimethylolpropane. Polyalkylene glycols such as polypropylene glycol, polytetramethylene glycol, or random or block copolymers of C2 C4 alkylene oxide groups may also be selected as the carrier. Polyethylene glycols and derivatives thereof are presently preferred. It is important that the carriers be compatible with the polymer. For example, it is presently preferred to use non-volatile non-polymerizable plasticizers that have less than 2 nucleophilic groups, such as hydroxyl groups, when blended with polymers having acid functionality, since compounds having more than two nucleophilic groups may result in crosslinking of the composition in the extruder at the high extrusion temperatures. Importantly, the non-volatile carriers preferably form a relatively homogeneous solution with the aliphatic polyester polymer composition.

Non-woven web and sheets comprising the inventive compositions have good tensile strength; can be heat sealed to form strong bonds allowing specialty drape fabrication; can be made from renewable resources which can be important in disposable products; and can have high surface energy to allow wettability and fluid absorbency in the case of non-wovens (as measured for nonwovens using the Apparent Surface Energy test and absorbing water); and for films the contact angles often are less than 50 degrees, preferably less than 30 degrees, and most preferably less than 20 degrees when the contact angles are measured using distilled water on a flat film using the half angle technique described in U.S. Pat. No. 5,268,733 and a Tantec Contact Angle Meter, Model CAM-micro, Schamberg, Ill. In order to determine the contact angle of materials other than films, a film of the exact same composition should be made by solvent casting.

vi) Other Optional Additives

Plasticizers may be used with the aliphatic polyester thermoplastic and include, for example, glycols such glycerin; propylene glycol, polyethoxylated phenols, mono or polysubstituted polyethylene glycols, higher alkyl substituted N-alkyl pyrrolidones, sulfonamides, triglycerides, citrate esters, esters of tartaric acid, benzoate esters, polyethylene glycols and ethylene oxide propylene oxide random and block copolymers having a molecular weight less than 10,000 daltons, preferably less than about 5000 daltons, more preferably less than about 2500 daltons; and combinations thereof.

Other additional components include antioxidants, colorants such as dyes and/or pigments, antistatic agents, fluorescent brightening agents, odor control agents, perfumes and fragrances, active ingredients to promote wound healing or other dermatological activity, combinations thereof, and the like.

As described previously, these fillers and additional compounds can detrimentally effect physical properties of the web. Therefore, total additives other than the antishrink additive preferably are present at no more than 10% by weight, preferably no more than 5% by weight and most preferably no more than 3% by weight.

C. Methods of Making Dimensionally Stable Nonwoven Fibrous Webs

Exemplary processes that are capable of producing oriented fibers include: oriented film filament formation, melt-spinning, plexifilament formation, spunbonding, wet spinning, and dry spinning. Suitable processes for producing oriented fibers are also known in the art (see, for example, Ziabicki, Andrzej, Fundamentals of Fibre Formation: The Science of Fibre Spinning and Drawing, Wiley, London, 1976.). Orientation does not need to be imparted within a fiber during initial fiber formation, and may be imparted after fiber formation, most commonly using drawing or stretching processes.

In some exemplary embodiments, a dimensionally stable nonwoven fibrous web may be formed of fibers of varying sizes commingled to provide, e.g., a support structure for the smaller nonwoven fibers. The support structure may provide the resiliency and strength to hold the smaller fibers in the preferred low solidity form. The support structure could be made from a number of different components, either singly or in concert. Examples of supporting components include, for example, microfibers, discontinuous oriented fibers, natural fibers, foamed porous cellular materials, and continuous or discontinuous non oriented fibers.

1. Formation of Dimensionally Stable Nonwoven Fibrous Webs

The fibrous web can be made in accordance with conventional methods known in the art, including wet-laid methods, dry-laid methods, such as air layering and carding, and direct-laid methods for continuous fibers, such as spunbonding and meltblowing. Examples of several methods are disclosed in U.S. Pat. No. 3,121,021 to Copeland, U.S. Pat. No. 3,575,782 to Hansen, U.S. Pat. Nos. 3,825,379, 3,849,241, and 5,382,400.

A suitable example of a fibrous web can include tensilized nonfracturable staple fibers and binder fibers are used in the formation of the fibrous web, as described in U.S. Pat. Nos. 5,496,603; 5,631,073; and 5,679,190 all to Riedel et al. As used herein, "tensilized nonfracturable staple fibers" refer to staple fibers, formed from synthetic polymers that are drawn during manufacture, such that the polymer chains substantially orient in the machine direction or down web direction of the fiber, and that will not readily fracture when subjected to a moderate breaking force. The controlled orientation of these staple fibers imparts a high degree of ordered crystallinity (e.g. generally above about 45% crystallinity) to the polymer chains comprising the fibers. Generally, the tensilized nonfracturable staple fibers will not fracture unless subjected to a breaking force of at least 3.5 g/denier.

The fibrous web can also be interbonded with a chemical bonding agent, through physical entanglement, or both. One method of interbonding the fibrous web is to physically entangle the fibers after formation of the web by conventional means well known in that art. For example, the fibrous web can be needle-tacked as described in U.S. Pat. No. 5,016,331. In an alternative, and preferred method, the fibrous web can be hydroentangled, such as described in U.S. Pat. No. 3,485,706. One such method of hydroentangling involves passing a fibrous web layered between stainless steel mesh screens (e.g., 100 mesh screen, National Wire Fabric, Star City, Ark.) at a predetermined rate (e.g., about 23 m/min) through high pressure water jets (e.g., from about 3 MPa to about 10 MPa), that impinge upon both sides of the web. Thereafter, the hydroentangled webs are dried, and can be further processed as described herein.

The fibrous web may also be calendered using a smooth roll that is nipped against another smooth roll. The fibrous webs may be thermally calendered with a smooth roll and a solid back-up roll (e.g., a metal, rubber, or cotton cloth covered metal). During calendering, it is important to closely control the temperature and the pressure of the smooth rolls. In general, the fibers are thermally fused at the points of contact without imparting undesirable characteristics to the fibrous web, such as unacceptable stiffness and/or poor overtaping. In this regard, it is preferred to maintain the temperature of the smooth roll between about 70° C. and 220° C., more preferably between about 85° C. and 180° C. In addition, the smooth roll should contact the fibrous web at a pressure of from about 10 N/mm to about 90 N/mm, more preferably from about 20 N/mm to about 50 N/mm.

A variety of equipment and techniques are known in the art for melt processing polymeric fibers. Such equipment and techniques are disclosed, for example, in U.S. Pat. No. 3,565,985 (Schrenk et al.); U.S. Pat. No. 5,427,842 (Bland et. al.); U.S. Pat. Nos. 5,589,122 and 5,599,602 (Leonard); and U.S. Pat. No. 5,660,922 (Henidge et al.). Examples of melt processing equipment include, but are not limited to, extruders (single and twin screw), Banbury mixers, and Brabender extruders for melt processing the fibers.

Any additives may be compounded with the aliphatic polyester, or other materials prior to extrusion. Commonly, when additives are compounded prior to extrusion, they are compounded at a higher concentration than desired for the final fiber. This high concentration compound is referred to as a master batch. When a master batch is used, the master batch will generally be diluted with pure polymer prior to entering the fiber extrusion process. Multiple additives may be present in a masterbatch, and multiple master batches may be used in the fiber extrusion process.

Depending on the condition of the fibers, some bonding may occur between the fibers during processing. However, further bonding between the fibers in the collected web is usually needed to provide a matrix of desired coherency, making the web more handleable and better able to hold the fibers within the matrix ("bonding" fibers means adhering the fibers together firmly, so they generally do not separate when the web is subjected to normal handling).

Conventional bonding techniques using heat and pressure applied in a point-bonding process or by smooth calender rolls can be used, though such processes may cause undesired deformation of fibers or compaction of the web.

Thus, although heating the web in an autogenous bonding operation may cause fibers to weld together by undergoing some flow and coalescence at points of fiber intersection, the basic discrete fiber structure is substantially retained over the length of the fibers between intersections and bonds; preferably, the cross-section of the fibers remains unchanged over the length of the fibers between intersections or bonds formed during the operation. Similarly, although calendering of a web may cause fibers to be reconfigured by the pressure and heat of the calendering operation (thereby causing the fibers to permanently retain the shape pressed upon them during calendering and make the web more uniform in thickness), the fibers generally remain as discrete fibers with a consequent retention of desired web porosity, filtration, and insulating properties.

One advantage of certain exemplary embodiments of varying fiber sizes may be that the fibers held within a web may be better protected against compaction. The presence of the varying fiber sizes also may add other properties such as web strength, stiffness and handling properties.

The diameters of the fibers can be tailored to provide needed filtration, acoustic absorption, and other properties.

In addition to the foregoing methods of making a dimensionally stable nonwoven fibrous web, one or more of the following process steps may be carried out on the web once formed:

(1) advancing the dimensionally stable nonwoven fibrous web along a process pathway toward further processing operations;

(2) bringing one or more additional layers into contact with an outer surface of the fiber component, and/or the optional support layer;

(3) calendering the dimensionally stable nonwoven fibrous web;

(4) coating the dimensionally stable nonwoven fibrous web with a surface treatment or other composition (e.g., a fire retardant composition, an adhesive composition, or a print layer);

(5) attaching the dimensionally stable nonwoven fibrous web to a cardboard or plastic tube;

(6) winding-up the dimensionally stable nonwoven fibrous web in the form of a roll;

(7) slitting the dimensionally stable nonwoven fibrous web to form two or more slit rolls and/or a plurality of slit sheets;

(8) placing the dimensionally stable nonwoven fibrous web in a mold and molding the dimensionally stable nonwoven fibrous web into a new shape;

(9) applying a release liner over an exposed optional pressure-sensitive adhesive layer, when present; and

(10) attaching the dimensionally stable nonwoven fibrous web to another substrate via an adhesive or any other attachment device including, but not limited to, clips, brackets, bolts/screws, nails, and straps.

D. Articles Formed from Dimensionally Stable Nonwoven Fibrous Webs

The present disclosure is also directed to methods of using the dimensionally stable nonwoven fibrous webs of the present disclosure in a variety of applications. Exemplary articles are discussed above. Further applications or articles are described further in Applicants' co-pending applications PCT Application No. PCT/US2010/028263, filed Mar. 23, 2010 and U.S. Provisional Ser. Nos. 61/287,697 and 61/298,609, both filed Dec. 17, 2009.

The fibers are particularly useful for making absorbent or repellent aliphatic polyester nonwoven gowns and film laminate drapes used in surgery as well as personal care absorbents such as feminine hygiene pads, diapers, incontinence pads, wipes, fluid filters, insulation and the like.

Various embodiments of the presently disclosed invention also provides useful articles made from fabrics and webs of fibers including medical drapes, medical gowns, aprons, filter media, industrial wipes and personal care and home care products such as diapers, facial tissue, facial wipes, wet wipes, dry wipes, disposable absorbent articles and garments such as disposable and reusable garments including infant diapers or training pants, adult incontinence products, feminine hygiene products such as sanitary napkins and panty liners and the like. The fibers of this invention also may be useful for producing thermal insulation for garments such as coats, jackets, gloves, cold weather pants, boots, and the like as well as acoustical insulation. Articles made of the fibers may be solvent, heat, or ultrasonically welded together as well as being welded to other compatible articles. The fibers may be used in conjunction with other materials to form constructions such as sheath/core materials, laminates, compound structures of two or more materials, or useful as coatings on various medical devices. The fibers described herein may be useful in the fabrication of surgical sponges.

The hydrophilic characteristic of the fibers may improve articles such as wet and dry wipes by improving absorbency.

The ingredients of the fibers may be mixed in and conveyed through an extruder to yield a polymer, preferably without substantial polymer degradation or uncontrolled side reactions in the melt. Potential degradation reactions include transesterification, hydrolysis, chain scission and radical chain defibers, and process conditions should minimize such reactions. The processing temperature is sufficient to mix the biodegradable aliphatic polyester viscosity modifier, and allow extruding the polymer.

While the specification has described in detail certain exemplary embodiments, it will be appreciated that those skilled in the art, upon attaining an understanding of the foregoing, may readily conceive of alterations to, variations of, and equivalents to these embodiments. Accordingly, it should be understood that this disclosure is not to be unduly limited to the illustrative embodiments set forth hereinabove. Furthermore, all publications, published patent applications and issued patents referenced herein are incorporated by reference in their entirety to the same extent as if each individual publication or patent was specifically and individually indicated to be incorporated by reference. Various exemplary embodiments and details have been discussed above for purposes of illustrating the invention, various modifications may be made in this invention without departing from its true scope, which is indicated by the following claims.

What is claimed is:

1. A nonwoven web comprising a plurality of fibers, wherein the fibers comprise:

one or more thermoplastic aliphatic polyesters; and a semicrystalline antishrinkage additive in an amount greater than 0% and no more than 6% by weight of the web, wherein the antishrinkage additive forms a dispersed phase of discrete particulates randomly distributed in the aliphatic polyester fibers having an average diameter of less than 250 nm; wherein the particulates are in the form of spheres or ellipsoids;

wherein the thermoplastic aliphatic polyester is present in an amount of greater than 90% by weight of the thermoplastic polymer present in the fibers;

wherein the fibers exhibit molecular orientation;

wherein the fibers do not extend substantially endlessly through the web; and wherein the web has at least one dimension in the plane of the web which decreases by no greater than 12% when the web is heated to a temperature above a glass transition temperature of the fibers in an unrestrained condition.

2. The nonwoven web of claim 1, wherein at least a portion of the fibers in the nonwoven web are staple fibers.

3. The web of claim 2, further comprising one or more alkyl, alkenyl, aralkyl or alkaryl anionic surfactants incorporated into the polyester.

4. The web of claim 3, further comprising a surfactant carrier.

5. The web of claim 3, wherein the anionic surfactant is selected from the group consisting of one or more alkyl, alkenyl, alkaryl and arakyl sulfonates; alkyl, alkenyl, alkaryl and arakyl sulfates; alkyl, alkenyl, alkaryl and arakyl phosphonates; alkyl, alkenyl, alkaryl and arakyl phosphates; alkyl, alkenyl, alkaryl and arakyl carboxylates; alkyl alkoxylated carboxylates; alkyl alkoxylated sulfates; alkylalkoxylated sulfonates; alkyl alkoxylated phosphates; and combinations thereof.

6. The web of claim 5, wherein the anionic surfactant is selected from the group consisting of (C8-C22) alkyl sulfate salts, di(C8-C18) sulfosuccinate salts, C8-C22 alkyl sarconsinate salts, C8-C22 alkyl lactyalte salts, and combinations thereof.

7. The web of claim 3, wherein the anionic surfactant is present in an amount of at least 0.25% and no greater than 8% by weight of the composition.

8. The web of claim 1, wherein the semicrystalline antishrinkage additive is selected from the group consisting of polypropylene, polyethylene, polyamides, polyesters, blends and copolymers thereof.

9. The web of claim 8, wherein the semicrystalline antishrinkage additive is semicrystalline polypropylene.

10. The web of claim 3, wherein the nonwoven web remains hydrophilic after more than 10 days at 45° C.

11. The web of claim 2, wherein the web further comprises synthetic fibers, natural fibers, and combinations thereof.

12. The web of claim 2, wherein the thermoplastic polyester is at least one aliphatic polyester selected from the group consisting of one or more poly(lactic acid), poly (glycolic acid), poly(lactic-co-glycolic acid), polybutylene succinate, polyhydroxybutyrate, polyhydroxyvalerate, blends, and copolymers thereof.

13. The web of claim 2, wherein the semicrystalline antishrinkage additive is semicrystalline polypropylene and is present in an amount from about 1% to about 6% by weight of the web.

14. The web of claim 2, wherein the fibers exhibit a median fiber size of no greater than 200 denier.

15. The web of claim 2, wherein the fiber is a bicomponent fiber.

16. The web of claim 2, wherein the nonwoven web is selected from the group consisting of a carded web, airlaid web, wetlaid web, or combinations thereof.

17. The web of claim 2, wherein the nonwoven web is bonded to form a hydroentangled web, a thermal-bonded web, a resin-bonded web, a stitch-bonded web, a needle-tacked web, or combinations thereof.

18. The web of claim 2, further comprising an antimicrobial component.

19. An article comprising the web of claim 2 and a film, membrane, nonwoven, or scrim extrusion bonded or thermally laminated directly to the web.

20. A nonwoven web comprising a plurality of fibers, wherein the fibers comprise:

one or more thermoplastic aliphatic polyesters; and an antishrinkage additive in an amount greater than 0% and no more than 6% by weight of the web, wherein the antishrinkage additive forms a dispersed phase of discrete particulates randomly distributed in the aliphatic polyester fibers having an average diameter of less than 250 nm; wherein the particulates are in the form of spheres or ellipsoids wherein the thermoplastic aliphatic polyester is present in an amount of greater than 90% by weight of the thermoplastic polymer present in the fibers;

wherein the fibers exhibit molecular orientation;

wherein the fibers do not extend substantially endlessly through the web; and wherein the web has at least one dimension in the plane of the web which decreases by no greater than 12% when the web is heated to a temperature above a glass transition temperature of the fibers in an unrestrained condition.

21. The nonwoven web of claim 20, wherein at least a portion of the fibers in the nonwoven web are staple fibers.

22. The web of claim 20, further comprising one or more alkyl, alkenyl, aralkyl or alkaryl anionic surfactants incorporated into the polyester.

23. The web of claim 22, further comprising a surfactant carrier.

24. The web of claim 22, wherein the anionic surfactant is selected from the group consisting of one or more alkyl, alkenyl, alkaryl and arakyl sulfonates; alkyl, alkenyl, alkaryl and arakyl sulfates; alkyl, alkenyl, alkaryl and arakyl phosphonates; alkyl, alkenyl, alkaryl and arakyl phosphates; alkyl, alkenyl, alkaryl and arakyl carboxylates; alkyl alkoxylated carboxylates; alkyl alkoxylated sulfates; alkylalkoxylated sulfonates; alkyl alkoxylated phosphates; and combinations thereof.

25. The web of claim 24, wherein the anionic surfactant is selected from the group consisting of (C8-C22) alkyl sulfate salts, di(C8-C18) sulfosuccinate salts, C8-C22 alkyl sarconsinate salts, C8-C22 alkyl lactyalte salts, and combinations thereof.

26. The web of claim 22, wherein the anionic surfactant is present in an amount of at least 0.25% and no greater than 8% by weight of the composition.

27. The web of claim 20, wherein the nonwoven web remains hydrophilic after more than 10 days at 45° C.

28. The web of claim 20, wherein the web further comprises synthetic fibers, natural fibers, and combinations thereof.

29. The web of claim 20, wherein the thermoplastic polyester is at least one aliphatic polyester selected from the group consisting of one or more poly(lactic acid), poly (glycolic acid), poly(lactic-co-glycolic acid), polybutylene succinate, polyhydroxybutyrate, polyhydroxyvalerate, blends, and copolymers thereof.

30. The web of claim 20, wherein the antishrinkage additive is present in an amount from about 1% to about 6% by weight of the web.

31. The web of claim 20, wherein the fibers exhibit a median fiber size of no greater than 200 denier.

32. The web of claim 20, wherein the fiber is a bicomponent fiber.

33. The web of claim 20, wherein the nonwoven web is selected from the group consisting of a carded web, airlaid web, wetlaid web, or combinations thereof.

34. The web of claim 20, wherein the nonwoven web is bonded to form a hydroentangled web, a thermal-bonded web, a resin-bonded web, a stitch-bonded web, a needle-tacked web, or combinations thereof.

35. The web of claim 20, further comprising an antimicrobial component.

36. An article comprising the web of claim 20 and a film, membrane, nonwoven, or scrim extrusion bonded or thermally laminated directly to the web.

* * * * *